US011680398B2

(12) United States Patent
Eisenberg

(10) Patent No.: US 11,680,398 B2
(45) Date of Patent: Jun. 20, 2023

(54) STRATA SPACE FRAME

(71) Applicant: Jacob Eisenberg, Loxahatchee, FL (US)

(72) Inventor: Jacob Eisenberg, Loxahatchee, FL (US)

( * ) Notice: Subject to any disclaimer, the term of this patent is extended or adjusted under 35 U.S.C. 154(b) by 0 days.

(21) Appl. No.: 17/498,265

(22) Filed: Oct. 11, 2021

(65) Prior Publication Data

US 2022/0112706 A1 Apr. 14, 2022

Related U.S. Application Data

(60) Provisional application No. 63/090,279, filed on Oct. 12, 2020.

(51) Int. Cl.
*E04B 1/19* (2006.01)

(52) U.S. Cl.
CPC .... *E04B 1/1903* (2013.01); *E04B 2001/1918* (2013.01); *E04B 2001/1933* (2013.01); *E04B 2001/1963* (2013.01); *E04B 2001/1972* (2013.01); *E04B 2001/1984* (2013.01); *E04B 2001/1996* (2013.01)

(58) Field of Classification Search
CPC ..... E04B 1/1903; E04B 2001/1918; E04B 2001/1933; E04B 2001/1963; E04B 2001/1972; E04B 2001/1984; E04B 2001/1996; E04B 2001/1954; E04B 1/19; E04B 2001/1975; E04B 2001/1978; E04B 2001/1987
See application file for complete search history.

(56) References Cited

U.S. PATENT DOCUMENTS 1,526,463 A 2/1925 Dawson
2,869,693 A * 1/1959 Wood ..... E04B 1/19 52/648.1
3,370,393 A * 2/1968 Hale ..... E04C 2/34 52/654.1
3,830,031 A * 8/1974 Soisson ..... E04B 1/3441 52/645
3,884,646 A * 5/1975 Kenney ..... B21D 22/02 156/196
3,948,012 A * 4/1976 Papayoti ..... E04B 1/19 52/654.1
4,103,470 A * 8/1978 Cook ..... E04B 1/19 52/654.1
4,241,746 A * 12/1980 Rothe ..... E04H 15/50 52/645
4,805,368 A * 2/1989 Wesselski ..... B64G 99/00 403/30
4,912,889 A * 4/1990 Palumbo ..... E04B 1/19 403/171
5,007,220 A * 4/1991 Lalvani ..... E04B 1/32 403/174

(Continued)

*Primary Examiner* — Rodney Mintz
(74) *Attorney, Agent, or Firm* — Koffsky Schwalb LLC

(57) ABSTRACT

A space frame is provided having a first set of nodes located along a first surface and a second set of nodes located along a second surface, and a unitary cell. The second surface non-intersecting the first surface. The unitary cell comprises at least four continuous web elements and extending in three dimensions. The unitary cell spans at least two nodes of the first set of nodes and at least two nodes of the second set of nodes.

18 Claims, 11 Drawing Sheets

(56) References Cited

U.S. PATENT DOCUMENTS 5,014,484 A * 5/1991 Tanizawa ..... H01Q 1/08 52/645
5,165,214 A 11/1992 Codd
5,445,861 A 8/1995 Newton
5,505,035 A * 4/1996 Lalvani ..... E04B 1/19 52/311.2
7,143,550 B1 * 12/2006 Lopez ..... E04B 1/3205 52/81.3
7,954,296 B2 * 6/2011 Newland ..... E04B 1/19 52/645
7,992,353 B2 * 8/2011 Athan ..... E04B 1/3211 52/81.3
8,635,831 B2 * 1/2014 Rivers ..... E04B 1/19 52/652.1
9,127,450 B2 * 9/2015 Rivers ..... E04B 1/19
9,271,845 B2 * 3/2016 Hunt ..... A61F 2/30
9,745,736 B2 * 8/2017 Wadley ..... C23C 8/22
9,809,977 B2 * 11/2017 Carney ..... E04B 1/19
10,145,110 B2 * 12/2018 Carney ..... B23P 19/04
10,494,806 B2 * 12/2019 Yates ..... E04B 1/19
10,710,698 B2 * 7/2020 Carney ..... B29C 64/106
2009/0199503 A1 * 8/2009 Liew ..... E04B 1/19 52/646
2009/0274865 A1 * 11/2009 Wadley ..... C23C 16/045 428/110
2010/0058704 A9 * 3/2010 Liew ..... E04B 1/3441 52/646
2010/0139202 A1 * 6/2010 Athan ..... E04B 1/19 52/745.19
2010/0236184 A1 * 9/2010 Newland ..... E04B 1/19 52/653.1
2013/0067847 A1 * 3/2013 Rivers ..... E04B 1/1909 52/648.1
2014/0102034 A1 * 4/2014 Rivers ..... E04B 1/19 52/652.1
2014/0121776 A1 * 5/2014 Hunt ..... A61F 2/30942 623/17.16
2015/0132535 A1 * 5/2015 Hazenbrink ..... E04C 2/34 428/137
2016/0208372 A1 * 7/2016 Wadley ..... C23C 8/22
2016/0208476 A1 * 7/2016 Wadley ..... C22C 38/04
2017/0043883 A1 * 2/2017 Carney ..... B64C 1/068
2017/0145694 A1 * 5/2017 Carney ..... B23P 19/04
2017/0314267 A1 * 11/2017 Carney ..... E04C 3/02
2018/0211575 A1 7/2018 Opsomer
2019/0234089 A1 * 8/2019 Jamin ..... E04H 3/126
2019/0292768 A1 * 9/2019 Yates ..... E04B 1/19
2019/0382995 A1 * 12/2019 Chen ..... B25J 19/0091
2021/0379883 A1 * 12/2021 Sakamoto ..... G02B 1/00

* cited by examiner

STRATA SPACE FRAME

CROSS REFERENCE TO RELATED APPLICATION

This application claims the benefit of U.S. Provisional Application No. 63/090,279 filed on Oct. 12, 2020. The above identified patent application is herein incorporated by reference in its entirely and no part of the application has been disclaimed.

TECHNICAL FIELD

The present disclosure relates to a space frame for various uses, including for use in construction. More particularly, the present disclosure relates to a three-dimensional geometrical space frame structure and method of creating the space frame structure thereof.

BACKGROUND

In the field of architectural and structural engineering, space trusses and space frames are widely used structures constructed from interlocking linear struts (linear elements) in a geometric pattern. Space frames usually carry loads above them and are supported at one or more points at their bottom. The individual struts running along the top of the space trusses and space frames are called "chord elements," forming an upper and lower chord structures, respectively, and the individual struts connecting the upper and lower chord structures (i.e., forming the central portion of a space truss or a space frame) are called "web elements," forming a web structure. Such space trusses and space frames are rigid and lightweight and are preferred over other construction elements for spanning larger areas with limited interior supports.

Specifically, members in a space truss are pinned at their ends, thus the members resist load only through axial response. Because space truss members are released from bearing and shear, loading may only be applied to joints. On the other hand, existing space frames comprise members that are rigidly connected such that shear, bending, and axial forces resist loading. Since space frame joints may translate or rotate, all the six Degrees of Freedom ("DOF") must be considered for analysis.

Currently, various two-dimensional frames and three-dimensional space frames are known in the art. For example, open web steel joists (OWSJs) are two-dimensional (i.e., planar) structures that are fabricated using parallel chords and a triangulated web system, proportioned to span between bearing points.

None of the prior art space frames, however, include a three-dimensional unitary cell that is formed by bending a single piece of material (e.g., metal) such that it creates a web structure of the space frame.

In addition, none of the prior art space frames, include a three-dimensional unitary cell that is formed by bending a single piece of material (e.g., metal) such that it creates a web elements of the space frame and chord elements of the space frame, thus minimising the assembly process and minimising weight by eliminating the need for heavy machined parts.

What is needed is a space frame having a three-dimensional unitary cell formed by bending a single sheet of material (e.g., metal), such that three-dimensional unitary cell comprises continuous web elements and spans the nodes located along a first surface (e.g., top of the space frame) and the nodes located along a second surface (e.g., bottom of the space frame). Thus, such three-dimensional unitary cell, formed from a single sheet of material, can comprise all of the web members of the space frame.

What is also needed is a space frame having a three-dimensional unitary cell formed form a single sheet of material (e.g., metal) comprising continuous web elements and integrally formed extensions, such by bending a single sheet of material both the web elements and chord elements of the space frame are formed, merely requiring joining the chord elements with the web structure to form a space frame. Thus, such three-dimensional unitary cell, formed from a single sheet of material, may comprise web members of the space frame and at least some of the chord members of the space frame. In situation when the unitary cell comprises all of the chord members of the space frame, all that is required to assemble the space frame is to join the chord members with their corresponding web members.

The present invention aims at resolving the problems in the aforesaid prior arts.

SUMMARY

The objective is to provide a space frame that is a three-dimensional space frame. The space frame, as proposed in the present disclosure implements linear members (that span between different variety of joints of neighbouring nodes) that consist of a continuous material.

In accordance with a first aspect of the disclosure, a space frame comprises a first set of nodes located along a first surface, and a second set of nodes located along a second surface. The second surface is non-intersecting the first surface. The space frame further includes a unitary cell comprising at least four continuous web elements and extending in three dimensions, the unitary cell spanning at least two nodes of the first set of nodes and at least two nodes of the second set of nodes.

In accordance with an embodiment of the invention, the unitary cell comprises at least seven continuous web elements and spans at least three nodes of the first set of nodes and at least three nodes of the second set of nodes.

In accordance with an embodiment, the space frame further comprises a first chord element and a second chord element, the first and second chord elements coupling a first node, a second node, and a third node of the at least three nodes of the first set of nodes. The space frame further comprises a third chord element and a fourth chord element, the third and fourth chord elements coupling a first node, a second node, and a third node of the at least three nodes of the second set of nodes.

In accordance with an embodiment, at least one of (i) the first and second chord elements and (ii) the third and fourth chord elements are formed as an integral part of the unitary cell.

In accordance with an embodiment, the first and second chord elements are integrally formed with the unitary cell at a single one of the first, second, and third nodes of the at least three nodes of the first set of nodes. Each of the first and second chord elements extends to a different one of the other two nodes of the first, second, and third nodes of the at least three nodes of the first set of nodes.

In accordance with an embodiment, the first chord element is integrally formed with the unitary cell at the first node of the at least three nodes of the first set of nodes and extending toward the second node of the at least three nodes of the first set of nodes.

In accordance with an embodiment, the first and second chord elements are joined to the unitary cell at the different one of the other two nodes of the first, second, and third nodes of the at least three nodes of the first set of nodes by a bolt-and-nut connection.

In accordance with an embodiment, the first and second chord elements are joined to the unitary cell at the different one of the other two nodes of the first, second, and third nodes of the at least three nodes of the first set of nodes by a welded connection.

The second chord element is one of (i) integrally formed with the unitary cell at the second node of the at least three nodes of the first set of nodes and extends toward the third node of the at least three nodes of the first set of nodes, and (ii) integrally formed with the unitary cell at the third node of the at least three nodes of the first set of nodes and extends toward the second node of the at least three nodes of the first set of nodes.

In accordance with an embodiment, the first chord element is joined with the unitary cell at the second node of the at least three nodes of the first set of nodes by a bolt-and-nut connection.

In accordance with an embodiment, the space frame further comprises a fifth chord element and a sixth chord element, the fifth and sixth chord elements integrally formed with the unitary cell and coupling the first, second and third nodes of the at least three nodes of the first set of nodes to form a double shell along the first surface of the space frame. The space frame further comprises a seventh chord element and an eighth chord element, the seven and eighth chord elements integrally formed with the unitary cell and coupling a first, second, and third nodes of the at least three nodes of the second set of nodes to form a double shell along the second surface of the space frame.

In accordance with an embodiment, at least one element of (i) the chord elements and (ii) the web elements is profiled to provide reinforcement.

In accordance with an embodiment, at least one of the chord elements comprises a cable.

In accordance with an embodiment, a chord element spanning two nodes comprises a pair of sub-chord elements, with each sub-chord element of the pair of sub-chord elements having a first end and a second end. The sub-chord elements are secured to each other at their respective first ends. The second end of one sub-chord element of the pair of sub-chord elements is integrally formed with the unitary cell at one of the two nodes. The second end of the other sub-chord element of the pair of sub-chord elements is integrally formed with the unitary cell at the other node of the two nodes.

In accordance with another aspect of the disclosure, a space frame comprises a first set of nodes located along a first surface, a second set of nodes located along a second surface, and a unitary three-dimensional strut structure. The second surface is non-intersecting with the first surface. The unitary three-dimensional strut structure comprises a set of three extensions separately extending from a root node to a set of three other nodes of the space frame, respectively. The root node and one of the three other nodes are located along the first surface. Two of the three other nodes are located along the second surface.

In accordance with an embodiment, at least one of the extensions has a tubular shape.

In accordance with an embodiment, the unitary three-dimensional strut structure further comprises a fourth extension that extends from the root node to a fourth node located along the first surface. Two of the four extensions of the unitary three-dimensional strut structure are web elements, and the other two of the four extensions are chord elements.

In accordance with an embodiment, the space frame further comprising a plurality of joined unitary three-dimensional strut structures.

In accordance with an embodiment, the space frame further comprises a combination of two unitary three-dimensional structures and nine separate longitudinal members (extensions) joined together to form a three-dimensional frame having a plurality of chord elements along the first surface that are offset from a plurality of chord elements along the second surface.

In accordance with another aspect of the disclosure, a method of creating a space frame comprises the step of forming a planar sheet of material comprising at least six nodes. The method further comprises steps of bending the planar sheet such that at least three of the at least six nodes are positioned along a first surface and the remaining nodes of the at least six nodes are positioned along a second surface, the second surface non-intersecting the first surface, thereby forming a unitary cell that extends in three dimensions. In accordance with an embodiment, the method further comprises step of coupling each of the at least three of the at least six nodes of the unitary cell along the first surface with a corresponding node of the at least three nodes along the first surface using a first set of chord elements. The method further comprises step of coupling each of the remaining nodes along the second surface with a corresponding node of the remaining nodes of the at least six nodes of the unitary cell along the second surface using a second set of chord elements.

In the various embodiments of the invention, joining of the linear elements can be accomplished via various types of connectors known, such as bolt-and-nut, snap, welding, gluing, etc.

BRIEF DESCRIPTION OF THE DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and processes that are consistent with the subject matter as claimed herein.

DETAILED DESCRIPTION

Figure 1A:
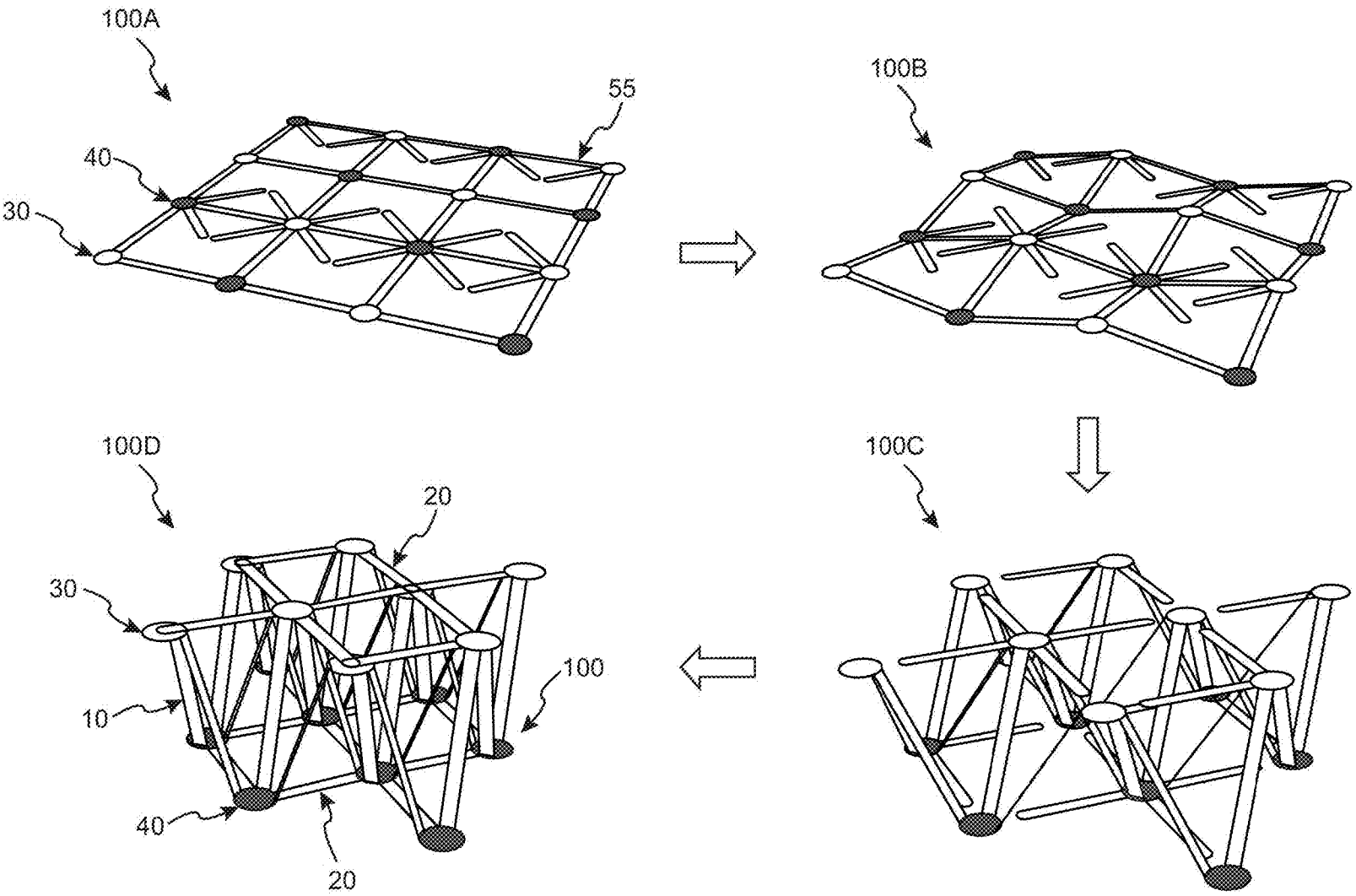
FIG. 1A shows various schematic diagrams of a space frame pertaining to different time stamps during a bending process and assembly from a planar sheet, in accordance with an embodiment of the disclosure.

The invention now will be described more fully hereinafter with reference to the accompanying drawings, in which embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section.

It will be understood that the elements, components, regions, layers and sections depicted in the figures are not necessarily drawn to scale.

The terminology used herein is for the purpose of describing particular embodiments only and is not intended to be limiting of the invention. As used herein, the singular forms "a," "an," and "the" are intended to include the plural forms as well, unless the context dearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," "left" or "right," "above" or "below," "front" or "rear," may be used herein to describe one element's relationship to another element as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. The numbers, ratios, percentages, and other values may include those that are ±5%, ±10%, ±25%, ±50%, ±75%, ±100%, ±200%, ±500%, or other ranges that do not detract from the spirit of the invention. The terms about, approximately, or substantially may include values known to those having ordinary skill in the art. If not known in the art, these terms may be considered to be in the range of up to ±5%, ±10%, or other value higher than these ranges commonly accepted by those having ordinary skill in the art for the variable disclosed. Thus, embodiments of the present invention should not be construed as limited to the particular shapes regions illustrated herein but are to include deviations in shapes that result, for example, from manufacturing. The invention illustratively disclosed herein suitably may be practised in the absence of a elements that are not specifically disclosed herein.

FIG. 1A shows various schematic diagrams of a space frame pertaining to different time stamps during a bending process to form a unitary cell and assembly of a non-curved space frame from the unitary cell, in accordance with an embodiment of the disclosure. As used in this disclosure, the term unitary cell refers to a unitary three-dimensional structure having at least four continuous web elements and spanning at least two nodes of the first set of nodes and two nodes of the second set of nodes. For example, the unitary cell of the present invention may comprise at least seven continuous web elements and continuously span at least three nodes of the first set of nodes and at least three nodes of the second set of nodes. In addition, the unitary cell of the present invention may further comprise one or more integrally formed chord elements. For such chord elements, one end of the chord element is integrally formed as a part of the unitary cell at one node while the other end of the chord element extends toward another node and is then either joined at its other end with the unitary cell or is joined with another chord member.

1B shows different schematic diagrams 101A to 101C of a bending process to form the unitary cell and an assembly of a curved space frame at three different time stamps from a single sheet of material (e.g., metal), in accordance with an embodiment of the disclosure. In both FIG. 1A and FIG. 1B, the unitary cell comprises both web elements and integrally formed chord elements.

Figure 1B:
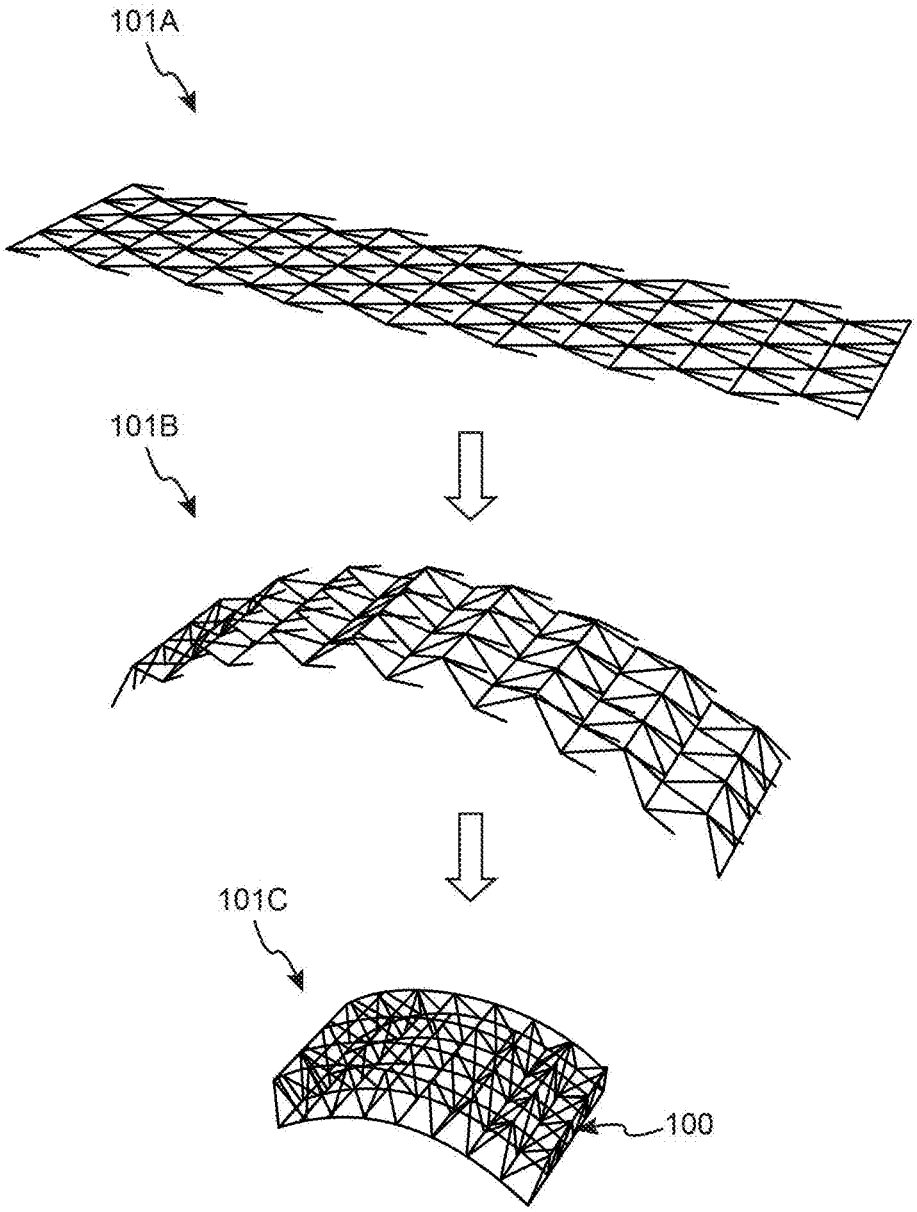
FIG. 1B shows various schematic diagrams of a curved space frame pertaining to different time stamps during a bending process and assembly from a planar sheet, in accordance with an embodiment of the disclosure.
Figure 1C:
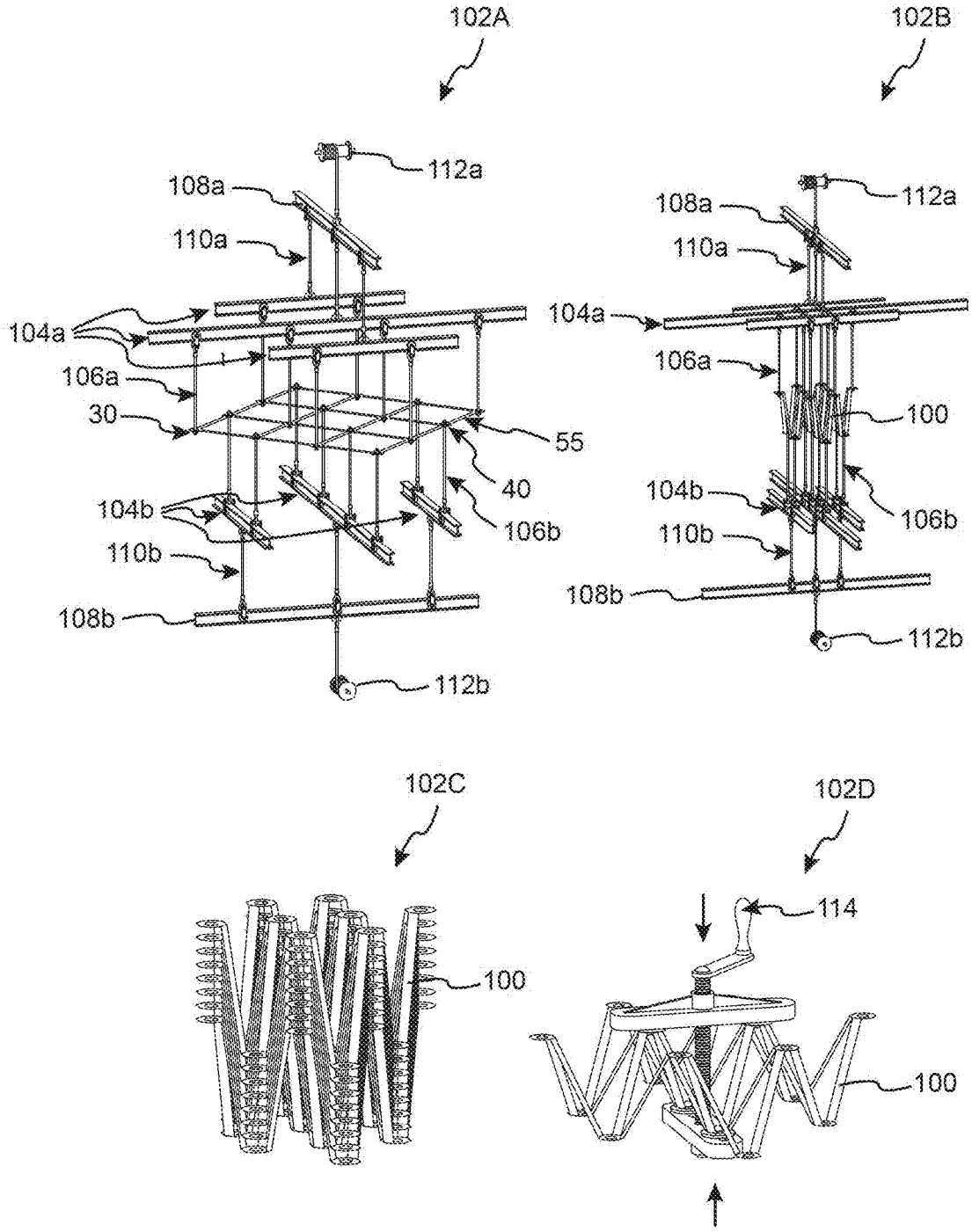
FIG. 1C shows various exemplary views during the securing, bending, compressing, stacking, and expanding of a unitary cell of a space frame, in accordance with an embodiment of the disclosure.

FIG. 1C shows various exemplary views during the securing, bending, compressing, stacking, and expanding of a unitary cell of a space frame, in accordance with an embodiment of the disclosure. In FIG. 1C, the three-dimensional unitary cell that is formed by bending includes only web elements.

Turning to FIG. 1A, an initial schematic diagram 100A corresponds to an uncompressed stage. The planar sheet 55 of material (e.g., metal) includes a number of first set of nodes 30, a number of second set of nodes 40, and a number of linear elements lying in a single horizontal plane. Some of the linear elements are integrally formed with the sheet at only one of their ends. Bending of the planar sheet creates a unitary cell 100 that extends in three-dimensions and comprises web elements 10, chord elements 20, first set of nodes 30, and second set of nodes 40 along two different surfaces. In an exemplary scenario, a single continuous metal sheet, such as monolith, is stamped and in accordance with a desired type of space frame, without any bending of any element therein. Once the bending is completed, the resulting chord elements 20 at upper and lower surfaces of the structure are joined to the web elements to form a complete space frame.

An exemplary view 102A of a mechanical arrangement for securing an uncompressed single continuous metal sheet is depicted in FIG. 1C. Corresponding to the uncompressed stage, the single continuous metal planar sheet 55 comprises the first set of nodes 30 and second set of nodes 40 in the single horizontal plane. A primary set of bars 104*a* is secured to corresponding group of diagonally aligned nodes of each of the first set of nodes 30, via a first set of slidable longitudinal tabs 106*a* configured to move the nodes closer during compression. A secondary bar 108*a* is secured to the primary set of bars 104*a*, via a second set of slidable longitudinal tabs 110*a* configured to move the nodes closer in orthogonal direction during the compression. The secondary bar 108*a* may be pulled in the upward direction by a first pulley 112*a*.

Further, another primary set of bars 104*b* is secured to corresponding group of diagonally aligned nodes of each of the second set of nodes 40, via another first set of slidable longitudinal tabs 106*b* configured to move the nodes closer during compression. Another secondary bar 108*b* is secured to the other primary set of bars 104*b*, via another second set of slidable longitudinal tabs 110*b* configured to move the nodes closer in orthogonal direction during the compression. The other secondary bar 108*b* may be pulled in the downward direction by a second pulley 112*b*.

As the bending process or the compression starts, the first set of nodes 30 and the second set of nodes 40 start compressing, as depicted by the intermediatory schematic diagrams 102B and 102C, to result in a three-dimensional unitary cell 100 comprising web elements of the space frame. In other words, each of the web elements extends through corresponding two nodes from the first set of nodes 30 and the second set of nodes 40 in multiple planes.

An exemplary view 102B of the mechanical arrangement for securing the compressed single continuous metal sheet after the compression process is depicted in FIG. 1C. During the compression process, the single continuous metal sheet secured by the mechanical arrangement in the initial state 102A may transition to a final state, i.e., the unitary cell 100. During compression process, the secondary bar 108*a* is pulled in the upward direction by a first pulley 112*a*, which in turn pulls the first set of nodes 30 in the upward direction. Simultaneously, the other secondary bar 108*b* is pulled in the downward direction by a second pulley 112*b*, which in turn pulls the second set of nodes 40 in the downward direction that results in the unitary cell 100 spanning nodes at an upper surface corresponding to the first set of nodes 30 and at a lower surface corresponding to the second set of nodes 40.

When such a unitary cell 100 needs to be transported to a space frame assembly site, it may be compressed even more, such that is occupies less volume during transport. Moreover, multiple compressed unitary cells can be stacked for transport purposes, as shown at 102C of FIG. 1C. Once brought to its final location, however, the unitary cell 100 can be expanded, via an expander 114, to its final stage for assembly into a space frame as shown at 102D.

For example, the final schematic diagram 100D in FIG. 1A corresponds to a final stage, referred to as a unitary cell 100 that is ready fir assembly into a space frame. As can be seen from FIG. 1A, the unitary cell is three-dimensional and spans a first surface comprising the first set of nodes 30 and a second surface comprising the second set of nodes 40.

FIG. 1B shows various schematic diagrams of a curved space frame pertaining to different time stamps during a bending process and assembly from a planar sheet. In accordance with an embodiment, a planar sheet 101A includes a number of linear elements, some of which will form web elements of the space frame and others that will form chord elements of the space frame. Bending of the planar sheet at 102B starts forming a three-dimensional unitary cell. Once bent into its final position, shown at 101C, the unitary cell 100, which includes the web and chord elements that are ready for joinder in order to form an assembled curved space frame.

FIGS. 2A to 2M depict perspective views of different types of space frames 200A to 200M respectively and corresponding elements, in accordance with various embodiment of the present disclosure. The different types of space frames 200A to 200M are assembled space frames and may include the three-dimensional unitary cell 100.

Figure 2A:
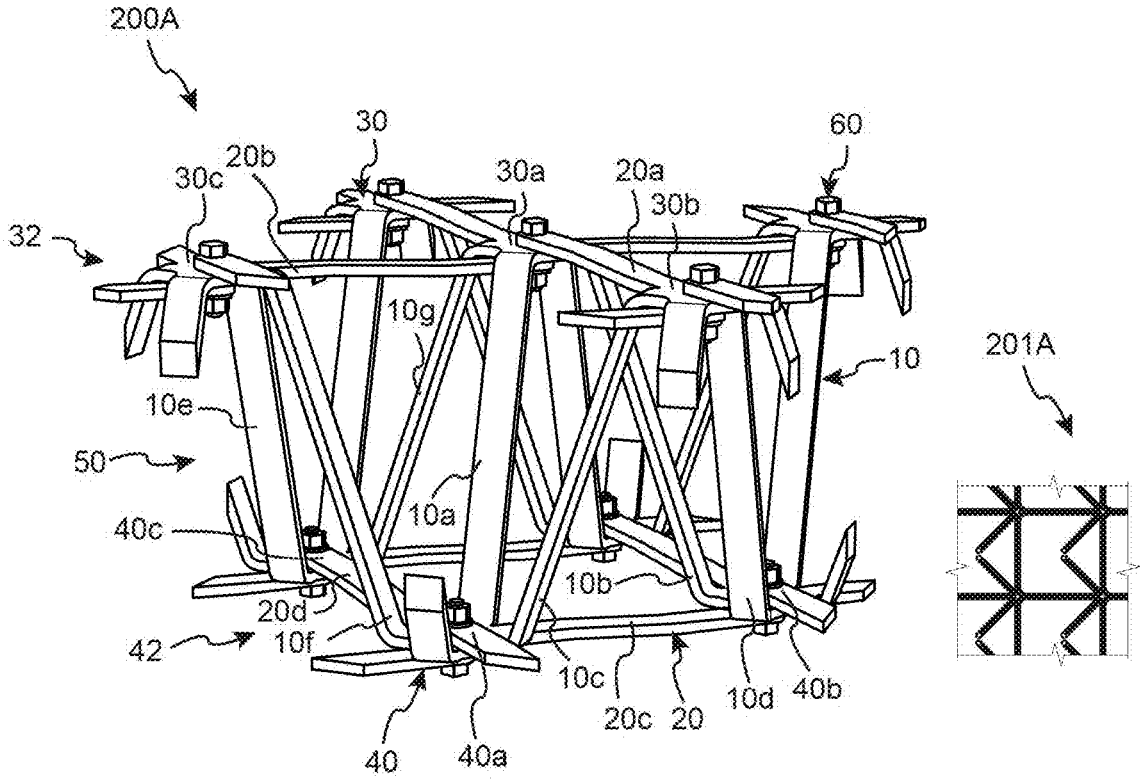
FIG. 2A shows a perspective view of a first type of space frame and corresponding elements, in accordance with an embodiment of the disclosure.

With reference to FIG. 2A, the first type of space frame 200A may correspond to a monolith space frame that requires a single sheet of material to form a three-dimensional unitary cell having both web and chord elements. Further, there is depicted a first plan view 201A of a metal sheet and/or elements from which a unitary cell is formed and from which the first type of space frame 200A gets assembled. The unitary cell of the space frame in FIG. 2A includes web elements and integrally formed chord elements. The number of metal sheets required to form the first type of space frame 200A is one. The holes shown in the metal sheet indicate points that correspond to joints of the assembled first type of space frame 200A, where the chord elements and web elements of the unitary cell are joined.

Figure 2B:
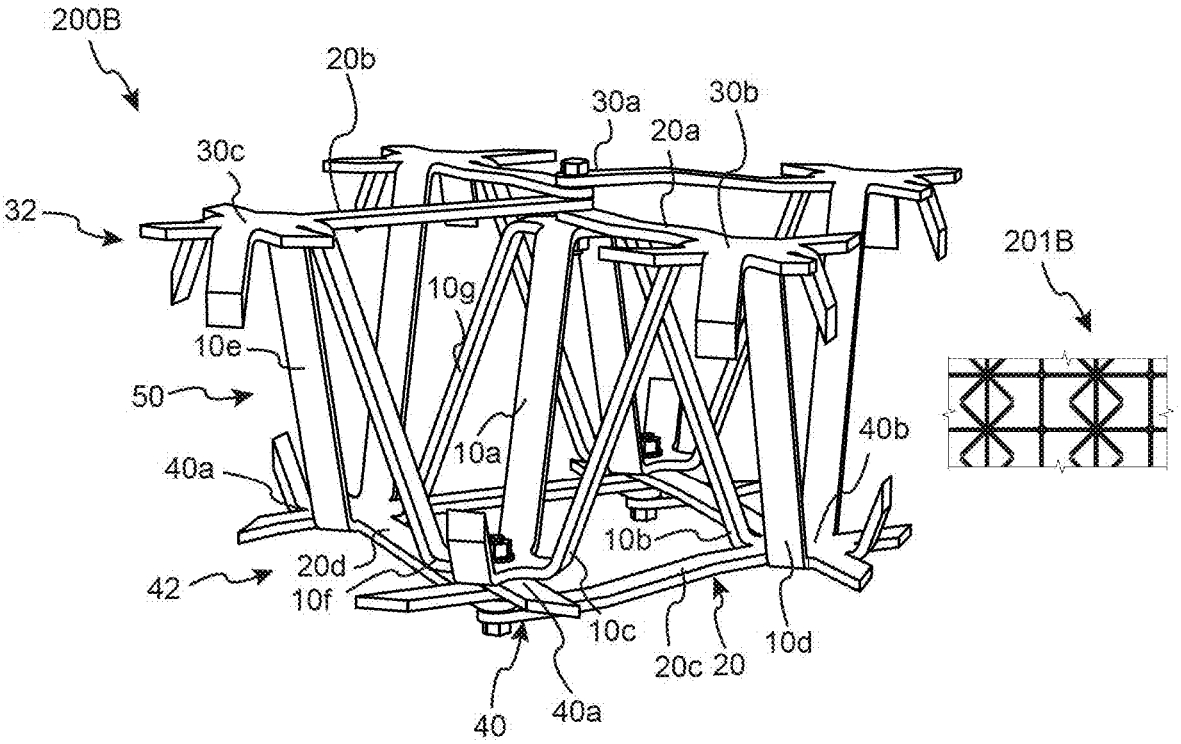
FIG. 2B shows a perspective view of a second type of space frame and corresponding elements, in accordance with another embodiment of the disclosure.

With reference to FIG. 2B, the second type of space frame 200B may also correspond to a monolith space frame, however, the second type of space frame 200B comprises half the number of the nodes (or joints), thus requires half the amount of assembly, as compared with the first type of space frame 200A. Further, there is depicted a second plan view 201B of a metal sheet and/or elements from which a unitary cell is formed and from which the second type of space frame 200B gets assembled. The number of metal sheets required to form the second type of space frame 200B is one. The holes shown in the metal sheet are missing at 50% of the intersections, which means that no joints are present at such locations in the assembled second type of space frame 200B. Reducing the number of joints required for assembly of a space frame reduces the assembly time.

Figure 2C:
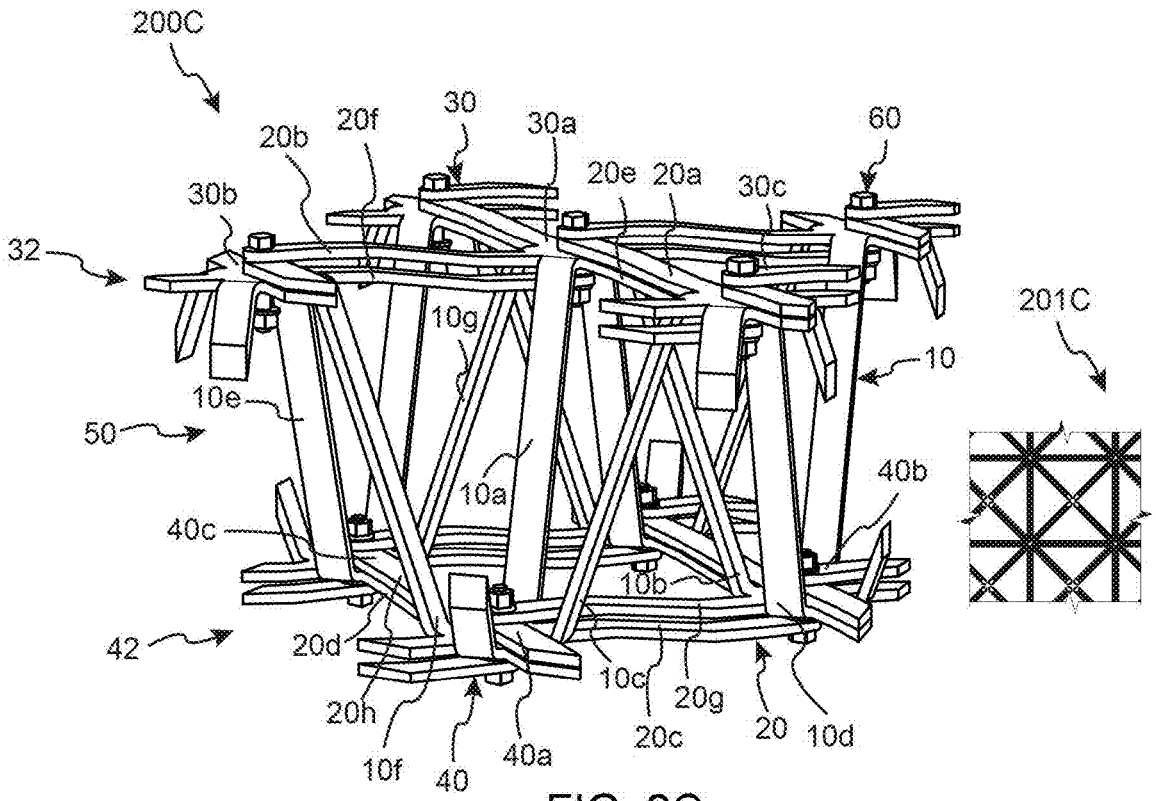
FIG. 2C shows a perspective view of a third type of space frame and corresponding elements, in accordance with another embodiment of the disclosure.

With reference to FIG. 2C, the third type of space frame 200C may also correspond to a monolith space frame that also requires only a single sheet. However, the third type of space frame 200C may include additional diagonally extending chord elements. Accordingly, the third type of space frame 200C may correspond to an assembled space frame having a double shell on top and bottom. Further, there is depicted a third plan view 201C of a metal sheet and/or elements from which the which a unitary cell is formed and from which third type of space frame 200C gets assembled. The number of metal sheets required to form the third type of space frame 200C is one. The holes shown in the metal sheet indicate points that correspond to joints of the assembled third type of space frame 200C.

Figure 2D:
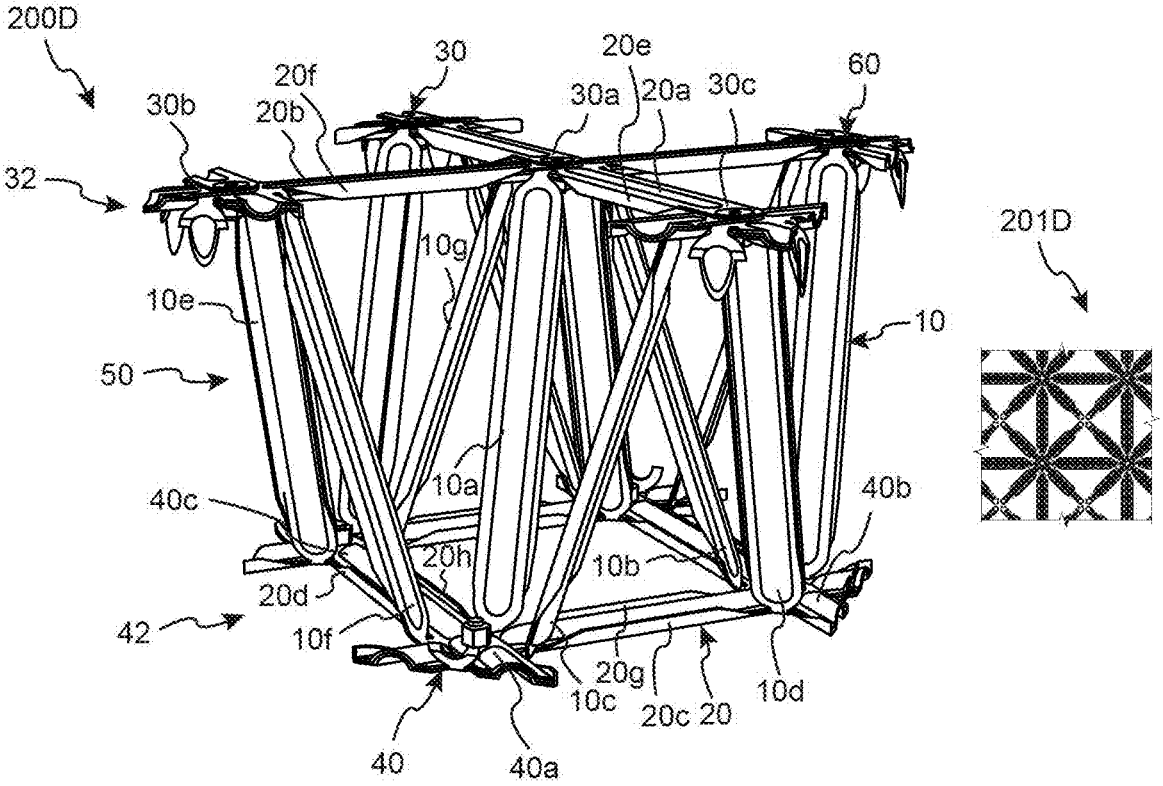
FIG. 2D shows a perspective view of a fourth type of space frame and corresponding elements, in accordance with another embodiment of the disclosure.

With reference to FIG. 2D, the fourth type of space frame 200D may be similar to the third type of space frame 200C except for the fact that the web elements (i.e., the central diagonally extended elements) and chord elements (i.e., the top and bottom horizontal elements) are profiled to create geometric reinforcement. Additionally, each node of the first set of nodes 30 and the second set of nodes 40 may be profiled. Such profiling results in providing extra strength to each joint and extension members (i.e. the web and the chord elements) as well. Such type of profiling may be preferred when the metal sheet is thin and has a high probability of bending in the middle. Further, there is depicted a fourth plan view 201D of a metal sheet and/or elements from which a unitary cell is formed and from which the fourth type of space frame 200D gets assembled. The number of metal sheets required to form the fourth type of space frame 200D is one. The holes shown in the metal sheet indicate points that correspond to joints of the assembled fourth type of space frame 200D.

Figure 2E:
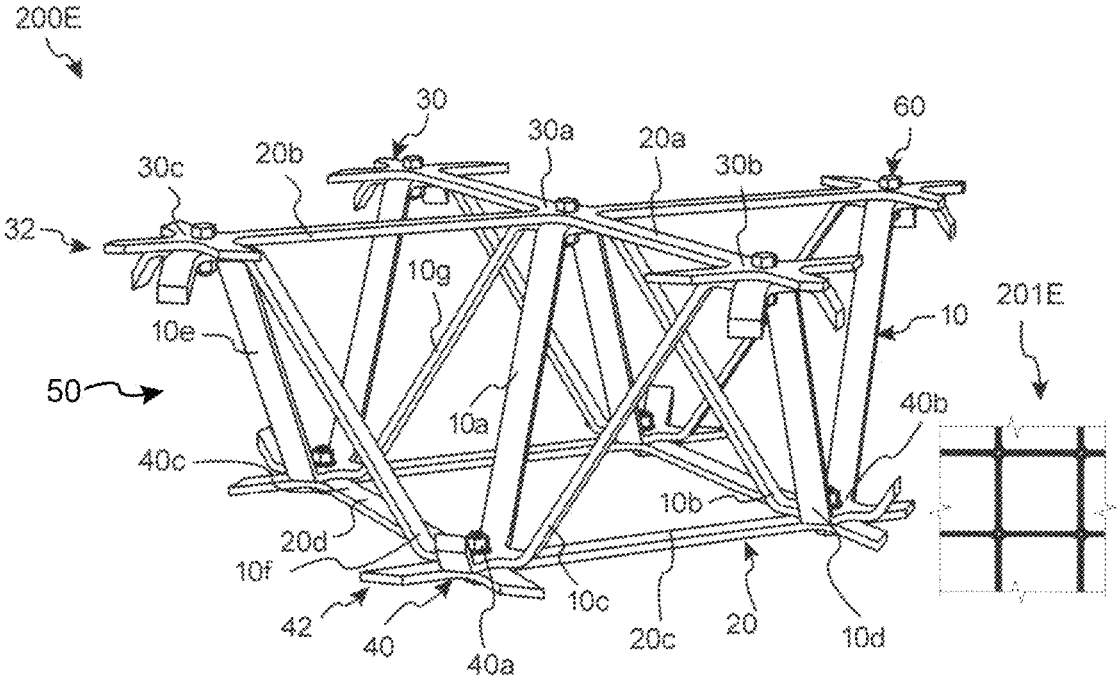
FIG. 2E shows a perspective view of a fifth type of space frame and corresponding elements, in accordance with another embodiment of the disclosure.

With reference to FIG. 2E, the fifth type of space frame 200E is a multi-plane space frame formed from three identical sheets. One sheet is used to create a three-dimensional unitary cell (i.e., the web structure) of the space frame. Other two sheets are used as the top and bottom grids, for forming top and bottom chord elements, respectively, of the space frame. Further, there is depicted a fifth plan view 201E of a metal sheet and/or elements from which a unitary cell is formed and from which the fifth type of space frame 200E gets assembled. The number of metal sheets required to form the fifth type of space frame 200E is three. The holes shown in the metal sheet indicate points that correspond to joints of the assembled fifth type of space frame 200E.

Figure 2F:
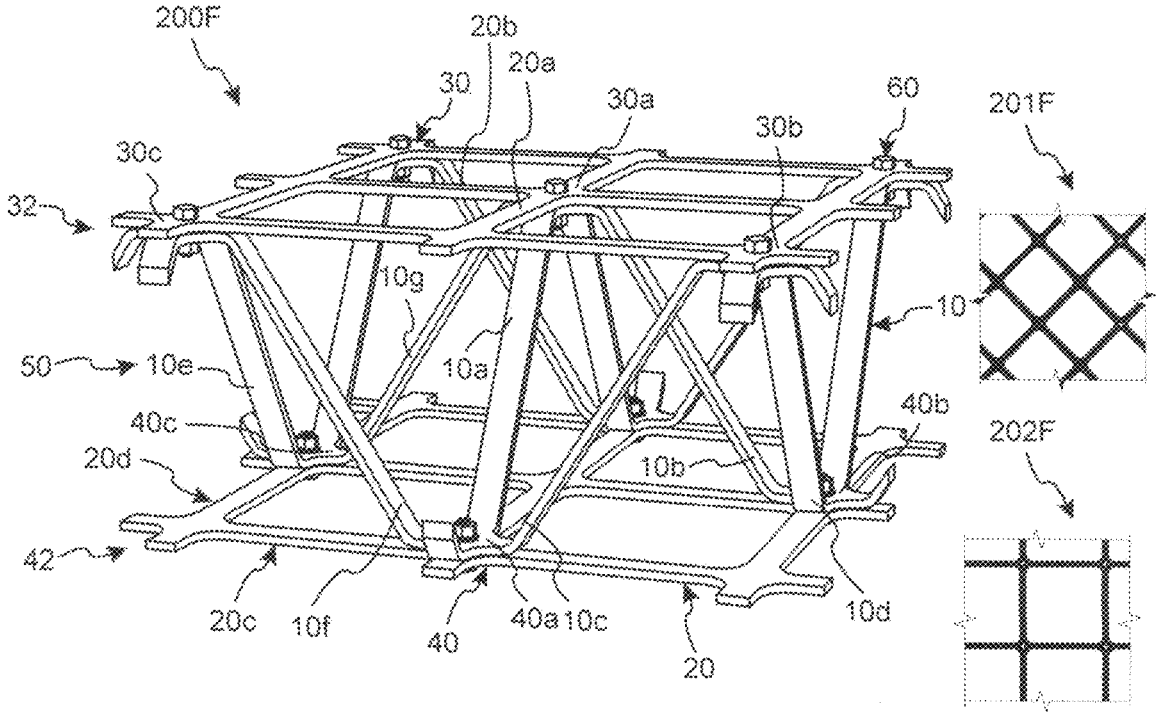
FIG. 2F shows a perspective view of a sixth type of space frame and corresponding elements, in accordance with another embodiment of the disclosure.

With reference to FIG. 2F, the sixth type of space frame 200F is also a multi-plane space frame but formed from three non-identical sheets. Further, there is depicted a sixth plan view 202F of a metal sheet and/or elements from which a unitary cell is formed and from which the sixth type of space frame 200F gets assembled. The number of metal sheets required to form the sixth type of space frame 200F is three. One sheet, shown at 202F, has holes at every intersect and forms the three-dimensional unitary cell having web elements only. Other two sheets, each shown at 201F, are used as top and bottom chord elements of the sixth type of space frame 200F. Further, the grid size in the top and bottom sheets is ½ of the grid size in the sheet that forms the unitary cell.

Figure 2G:
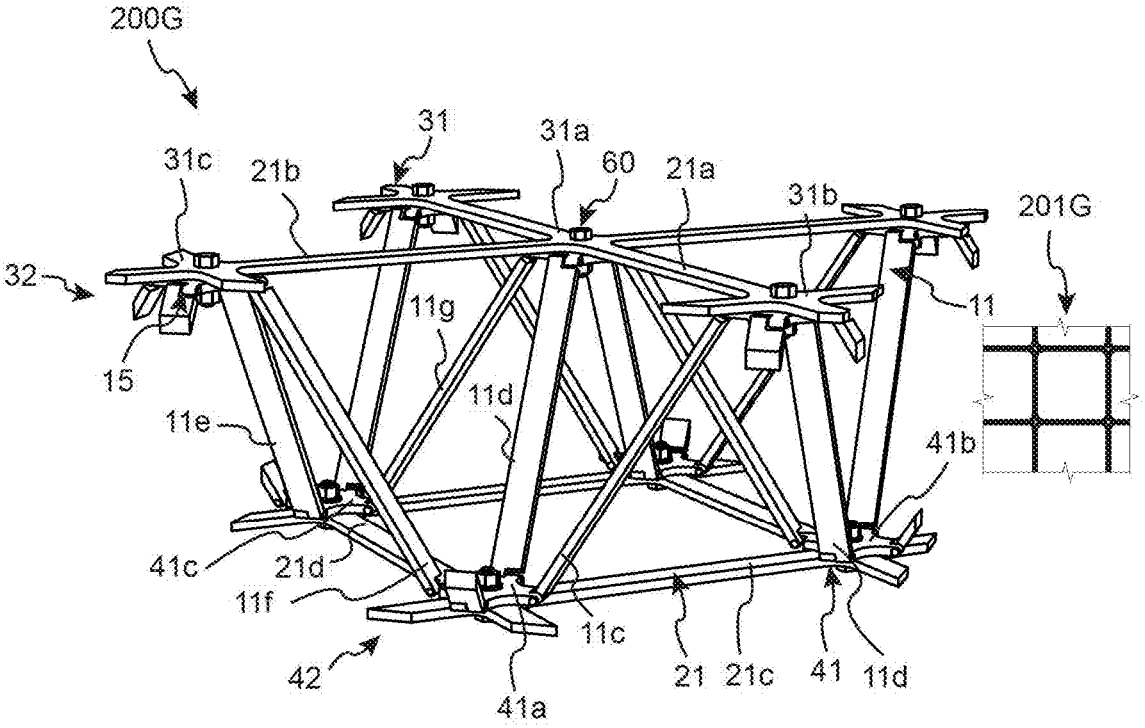
FIG. 2G shows a perspective view of a seventh type of space frame and corresponding elements, in accordance with another embodiment of the disclosure.

With reference to FIG. 2G, the seventh type of space frame 200G is a hinged frame in which the central web structure is formed from individual pieces, and does not comprise a unitary cell. Further, there is depicted a seventh plan view 201G of a metal sheet and/or elements from which the seventh type of space frame 200G gets assembled. The number of metal sheets required to form the seventh type of space frame 200G is two. The central web structure is formed from individual pieces, but the top and bottom are each formed from a single sheet. Because each of the central element consists of individual single pieces joined at the ends, the top and bottom sheets require holes at each intersection to attach to such pieces.

Figure 2H:
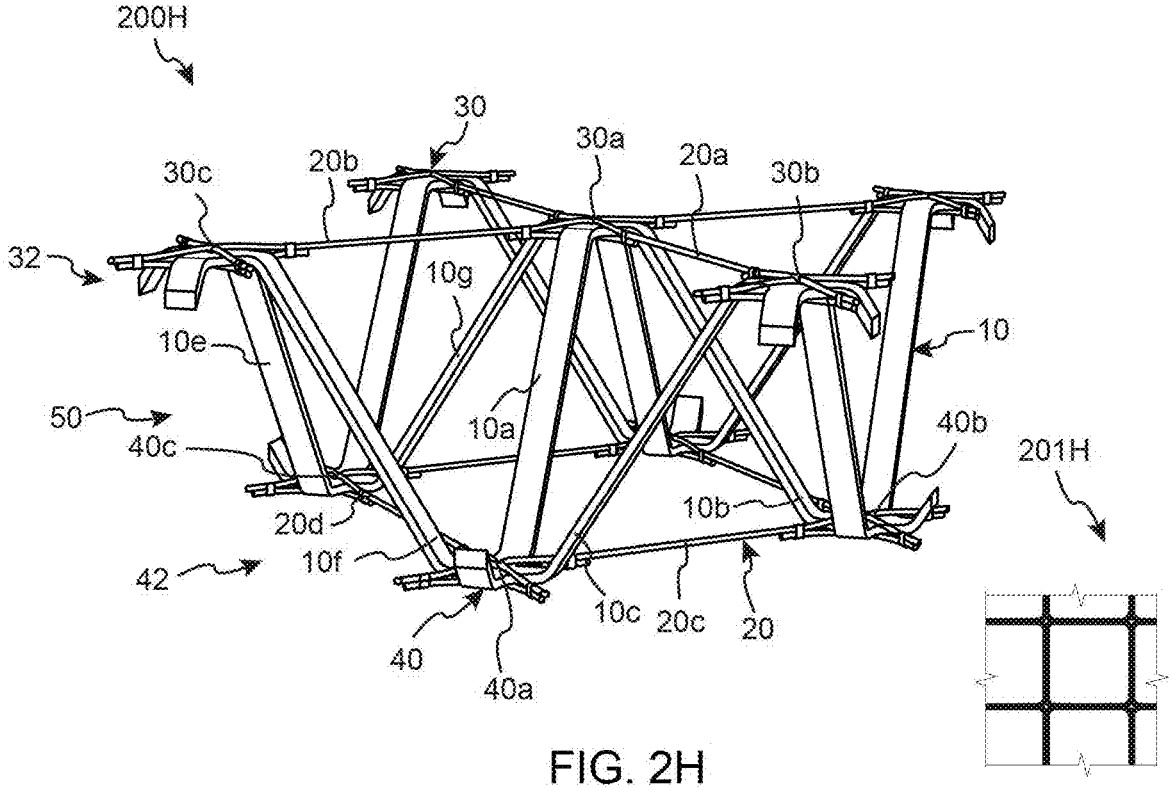
FIG. 2H shows a perspective view of a eighth type of space frame and corresponding elements, in accordance with another embodiment of the disclosure.

With reference to FIG. 2H, the eighth type of space frame 200H uses a unitary cell for web elements and individual cable pieces for upper and lower chord elements. At the top and bottom, the eighth type of space frame 200H connects the pieces of cable to the unitary cell. Further, there is depicted an eighth plan view 201H of a metal sheet and/or elements from which the unitary cell is formed, from which the eighth type of space frame 200H gets assembled. The number of metal sheets required to form the eighth type of space frame 200H is one. The holes shown in the metal sheet indicate points that correspond to joints of the assembled eighth type of space frame 200H.

Figure 2I:
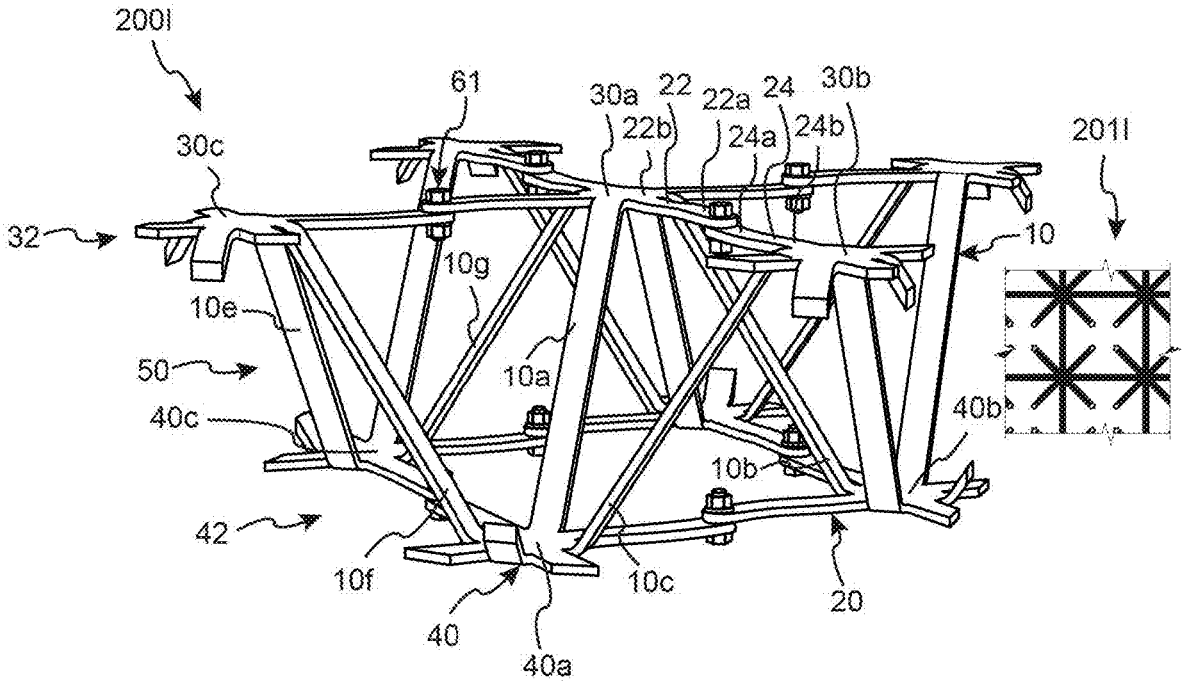
FIG. 2I shows a perspective view of a ninth type of space frame and corresponding elements, in accordance with another embodiment of the disclosure.

With reference to FIG. 2I, the ninth type of space frame 200I is a monolithic space frame, referred to as mid-linear space frame. The ninth type of space frame 200I is similar to the third type of space frame 200C and also uses a single sheet from which a unitary cell, comprising web and chord elements, is formed. Further, there is depicted a ninth plan view 201I of a metal sheet and/or elements from which a unitary cell is formed and from which the ninth type of space frame 200I gets assembled. The number of metal sheets required to form the ninth type of space frame 200I is one. However, the ninth type of space frame 200I does not have any holes at the cross-over points and the diagonal extensions, which become chord elements of the unitary cell, are shorter as compared to the third type of space frame 200C. Accordingly, the ninth type of space frame 200I results in the top and bottom of the space frame having joints not at the points of contact with the central element but at the mid-points between them.

Figure 2J:
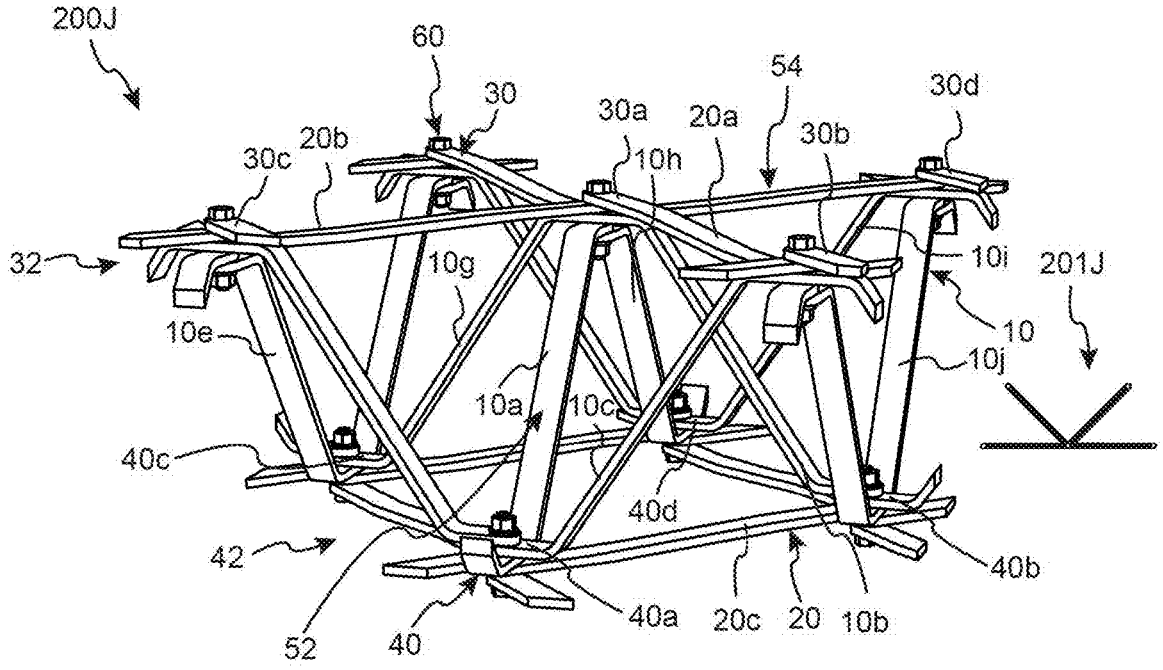
FIG. 2J shows a perspective view of a tenth type of space frame and corresponding elements, in accordance with another embodiment of the disclosure.

With reference to FIG. 2J, the tenth type of space frame 200J is referred to as a Quad, formed from unitary three-dimensional strut structures that are interconnected together. Further, there is depicted a tenth plan view 201J of a metal sheet and/or elements from which each strut structure is formed. When a three-dimensional strut structure is formed from the metal sheet in view 201J, it will have four legs extending from a single point (root node). Two of the four legs form chord elements of the space frame and the other two form web elements. The holes shown in the metal sheet indicate points that correspond to joints of the assembled tenth type of space frame 200J.

Figure 2K:
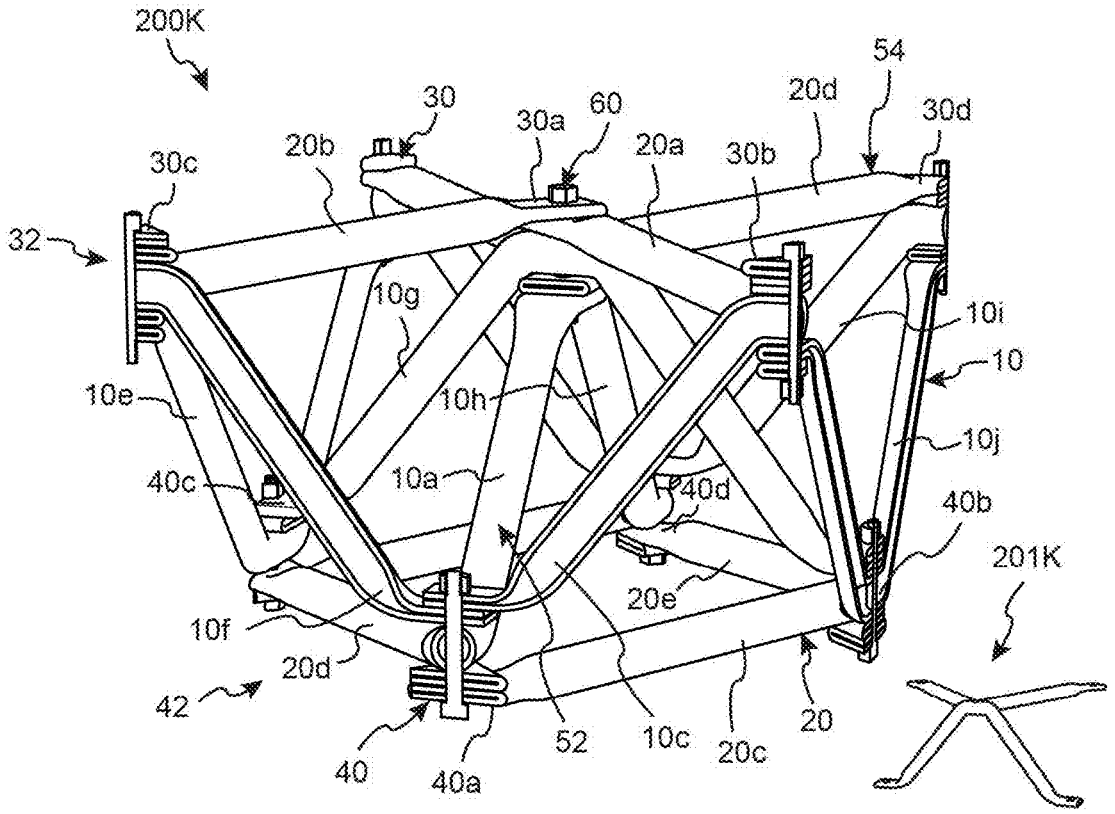
FIG. 2K shows a perspective view of an eleventh type of space frame and corresponding elements, in accordance with another embodiment of the disclosure.

With reference to FIG. 2K, the eleventh type of space frame 200K is referred to as a Quad-offset, that indicates that the legs are not flat, but have a tubular profile. Both of unitary three-dimensional strut structures of the tenth type of space frame 200J and the eleventh type of space frame 200K comprise a root node from which the extensions originate. Further, there is depicted an eleventh plan view 201K of a metal sheet and/or elements from which the unitary three-dimensional strut structure is formed and from which the eleventh type of space frame 200K gets assembled.

Figure 2L:
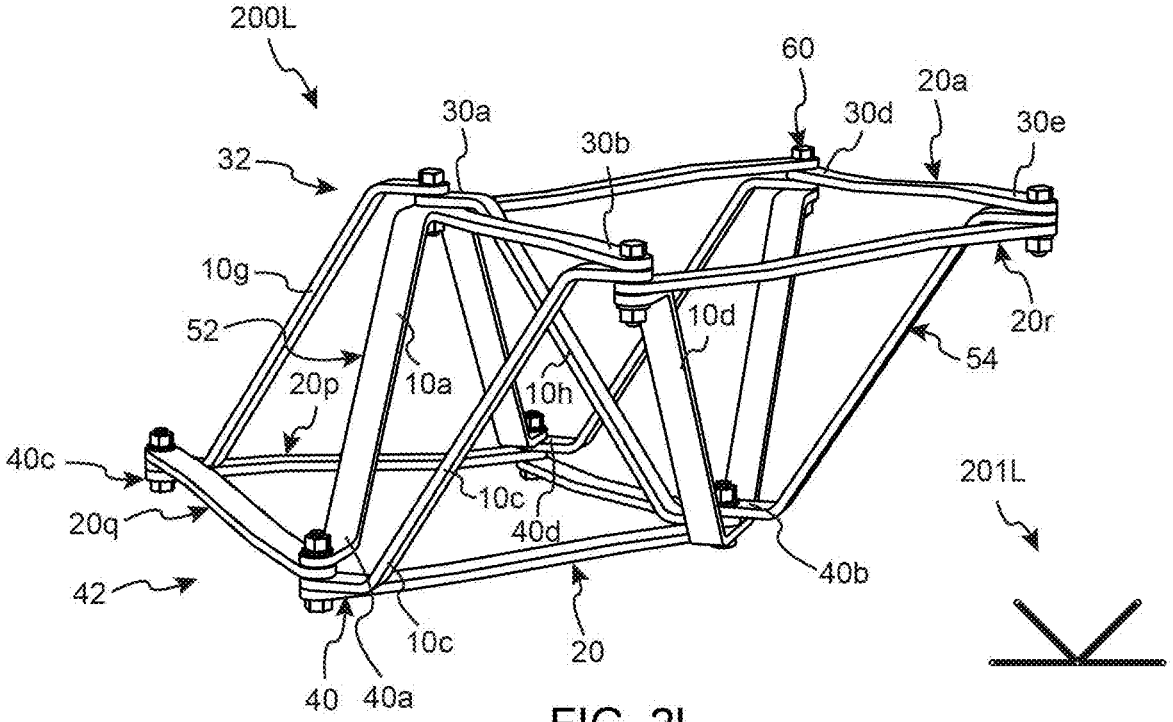
FIG. 2L shows a perspective view of a twelfth type of space frame and corresponding elements, in accordance with another embodiment of the disclosure.

With reference to FIG. 2L, the twelfth type of space frame 200L is similar to the tenth type of space frame 200J, except for the fact that the twelfth type of space frame 200L requires a combination of two unitary three-dimensional strut structures and nine single pieces. Further, there is depicted a twelfth plan view 201L of a metal sheet and/or elements from which each unitary three-dimensional strut structure is formed and from which the twelfth type of space frame 200L gets assembled. The holes shown in the metal sheet indicate points that correspond to joints of the assembled twelfth type of space frame 200L.

Figure 2M:
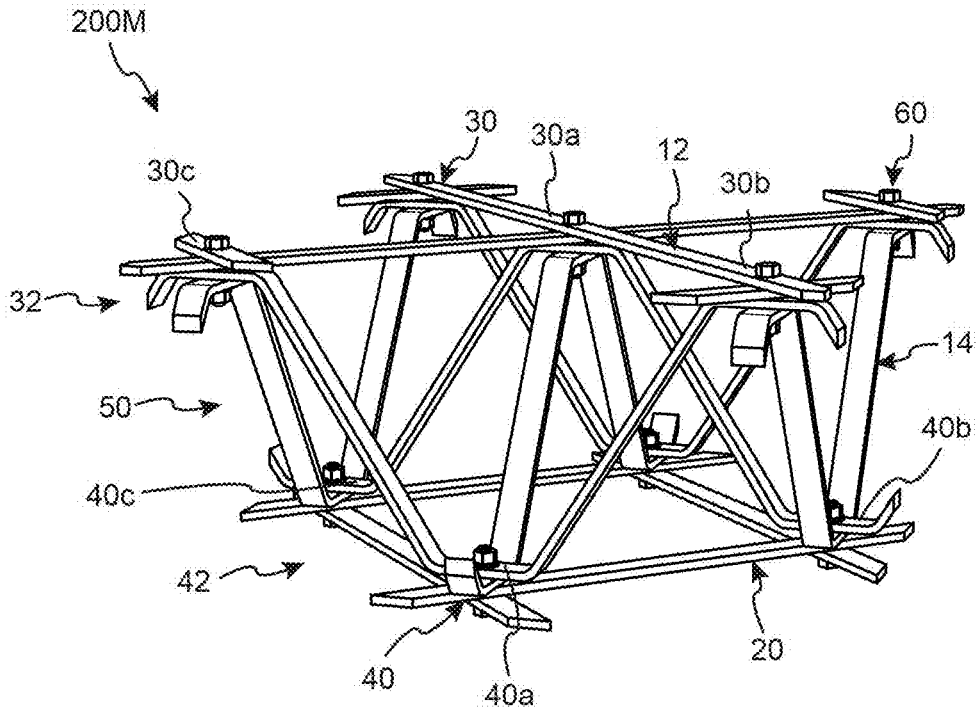
FIG. 2M shows a perspective view of a thirteenth type of space frame and corresponding elements, in accordance with another embodiment of the disclosure.

With reference to FIG. 2M, the thirteenth type of space frame 200M is composed from two types of continuous strips (flat and bent) that are joined together at their intersections. Specifically, the thirteenth type of space frame 200M has an array of continuous flat strips forming a grid pattern at the top, and another array of flat strips forming a grid pattern at the bottom. The central element is formed from an array of six wavy strips that are flat continuous strips that are bent into shape prior to installation. The top, centre, and bottom strips are then joined at their intersections.

It should be noted that the invention also contemplates using three-dimensional strut structures having only three legs, such that one of the three legs forms a chord element of the space frame, at either top or bottom surface of the space frame, and the other two form web elements. When using such a three-legged strut structures, however, additional individual linear members may be used to assemble a complete space frame.

In accordance with a first aspect of the disclosure, the unitary cell 100 as described in FIG. 1A, corresponds to a structure of a first set of linear elements that are ultimately joined with another set of linear elements, hereinafter interchangeably termed as extensions. The first set of linear elements may correspond to the web elements 10 and the second set of linear elements correspond to the chord elements 20. As depicted in FIG. 2A, the web elements 10 are vertically diagonal linear elements and the chord elements 20 are the upper and lower horizontally linear elements of the unitary cell 100. The web elements 10 and the chord elements 20 are made of weather-proof and corrosion-resistant metal, such as aluminium, of square cross-sectional configuration that can sustain compression and tension load factors for a given amount of weight of material. The web elements 10 and the chord elements 20 may be prefinished at the facility, i.e., the factory, if a specific colour or finish is required for aesthetic reasons in accordance with the desired structure of the space frame. The wall thickness of the web elements 10 and the chord elements 20 may correspond to minimum acceptable requirements with a resultant decrease of weight of the dead load factor of the structure of the space frame. In accordance with an embodiment, the first set of linear elements are joined with the other set of linear elements at their ends, with at least two sots of joints, such as the first set at the first set of nodes 30 and the second set at the second set of nodes 40.

As depicted in each of the different types of space frames 200A to 200M in respective FIGS. 2A to 2M, an imagined plane of the first set of nodes 30 may correspond to a first surface 32 and an imagined plane of the second set of nodes 40 may correspond to a second surface 42. Thus, the first set of nodes 30 is located along the first surface 32 and the second set of nodes 40 is located along the second surface 42.

In relation to each other, all the joints of one set, such as the joints at the first set of nodes 30, lay on a single imagined plane, such as the first surface 32, which doesn't intersect with itself or with the imagined plane of other set of joints, such as the joints located along the second surface 42. In a similar manner, the joints of the other set, such as at the second set of nodes 40, lay on another single imagined plane, such as the second surface 42, which doesn't intersect with itself or with the imagined plane of other set of joints, such as the joints located along first surface 32. Thus, the first surface 32 and the second surface 42 are non-intersecting with respect to each other. Examples of the different varieties of joints, such as at the first set of nodes 30 and at the second set of nodes 40, may include connectors (such as bolts-and-nut connections and snaps) and supplementary fastening means (such as welding and gluing).

In one preferred embodiment, the space frame is formed from a single sheet of material (e.g., metal) that has been profiled to create a required structure upon bending and joining some of the extensions. Thus, the space frame comprises a unitary cell having number of the continuous web elements 10 extending in three dimensions.

In accordance with an embodiment, an exemplary unitary cell spans a number of nodes from the first set of nodes 30 and the second set of nodes 40. For example, the exemplary unitary cell may be viewed to comprise four continuous web elements extending in three dimensions and spanning at least two nodes of the first set of nodes and two nodes of the second set of nodes. In accordance with an embodiment, the exemplary unitary cell may also be viewed to include seven continuous web elements, and span at least three nodes of the first set of nodes and at least three nodes of the second set of nodes. Further, the exemplary unitary cell may comprise a number of integrally formed chord elements 20. In certain embodiments, the web elements 10 and the chord elements 20 may be profiled to provide reinforcement. It may be noted that the number of elements may vary in accordance with location (for example, corner or centre) of the exemplary unitary cell within the space frame, and a specific type of space frame.

Structurally, the space frame consists of central linear members, i.e., the web elements 10, that correspond to the linear members spanning between two sets of nodes, i.e., the first set of nodes 30 and the second set of nodes 40. In one embodiment, each of such central linear members consists of a single, intact, continuous (without any folding back and doubling up) piece of material, i.e., forming the exemplary unitary cell.

Alternatively to using the exemplary unitary cell in a space frame or unitary strut structures, each of such central linear members in the space frame consist of separate elements permanently held together at both ends of each linear member (as illustrated in the seventh type of space frame 200G in FIG. 2G, referred to as the hinged configuration).

In accordance with an embodiment, the space frame with joints may be formed by affixing the ends of linear members stacked to each other by various means, such as weld, glue, bolt-and-nut, snap, or other such fastening mechanism. For example, as illustrated in the first type of space frame 200A in FIG. 2A, the stacked ends of the web elements 10 and the chord elements 20 are affixed to each other to form the joints (that correspond to the first set of nodes 30 and the second set of nodes 40) using a set of bolt-and-nut members 60 that are made of weather-proof and corrosion-resistant metal.

In accordance with another embodiment, as depicted in each of the different types of space frames 200A to 200G, and 200I to 200M in respective FIGS. 2A to 2G, and 2I to 2M, joints (located the first set of nodes 30 and the second set of nodes 40 (referenced as 31 and 41 in FIG. 2G, respectively)) have at least two linear members consisting of a single, intact piece of material, referred to as unified linear members. Thus, such unified linear members only occupy a single layer of the stack of joints. Multiple layers of the stack may consist of unified (continuous) linear members.

Turning to FIGS. 2A to 2F, 2H and 2I, in each of the different types of space frames 200A to 200F, 200H and 200I, there is depicted an exemplary unitary cell 50 that includes a number of the continuous web elements 10 spanning the first set of nodes 30 and the second set of nodes 40, in accordance with various embodiments of the present disclosure. It may be noted that the exemplary unitary cell 50 corresponds to the unitary cell 100 described in FIG. 1A. Broadly, in accordance with an embodiment, the exemplary unitary cell 50 may span at least four continuous web elements of the web elements 10, at least two nodes of the first set of nodes 30 and at least two nodes of the second set of nodes 40, (See, e.g., FIGS. 2E, 2F, and 2H, in which a unitary cell includes only web elements.)

More specifically, in accordance with another embodiment, for example in FIG. 2A, the exemplary unitary cell 50 may span at least seven continuous web elements (10*a*, 10*b*, 10*c*, 10*d*, 10*e*, 10*f*, 10*g*) of the web elements 10, at least first, second and third nodes (30*a*, 30*b*, 30*c*) of the first set of nodes 30 and at least first, second and third nodes (40*a*, 40*b*, 40*c*) of the second set of nodes 40. Structurally, a first web element 10*a* may couple node 30*a* and node 40*a*, a second web element 10*b* may couple node 30*a* and node 40*b*, a third web element 10*c* may couple node 30*b* and node 40*a*, and a fourth web element 10*d* may couple node 30*b* and node 40*b*. Similarly, a fifth web element 10*e* may couple node 30*c* and node 40*c*, sixth web element 10*f* may couple node 30*c* and node 40*a*, and a seventh web element 10*g* may couple node 30*a* and node 40*c*. In accordance with the second embodiment, the configuration and arrangement of the various members may be the minimum configuration that will allow for the exemplary unitary cell 50 that can remain upright while resting on a flat surface.

In addition, as illustrated in FIGS. 2A-2D, the exemplary unitary cell 50 of the present invention may further include integrally formed chord elements, such as chord elements 20*a*, 20*b*, 20*c*, and 20*d*, with one end of each chord element being a part of the exemplary unitary cell 50 and the other end joining the unitary cell via a connector, such as a bot-and-nut connector 60.

As illustrated in the embodiment of FIG. 2I, each of the chord elements extending between either the first set of nodes or the second set of nodes, may include two sub-chords (e.g., 22 and 24) that are joined midspan at their ends 22*a* and 24*a* by a bolt-and-nut connector 61, as opposed to being joined at the nodes; with the other sub-chord ends 22*b* and 24*b* integrally formed with the exemplary unitary cell 50.

In another embodiment, the exemplary unitary cell 50 may include a number of integrally formed chord elements that, when the space frame is assembled, form a double shell at the first set of nodes and the second set of nodes. For example, as shown in FIG. 2C, the exemplary unitary cell 50 may include the first chord element 20*a*, the second chord element 20*b*, the third chord element 20*c*, and the fourth chord element 20*d* in addition to a fifth chord element 20*e*, a sixth chord element 20*f*, a seventh chord element 20*g*, and an eighth chord element 20*h*. Specifically, the first chord element 20*a* and the second chord element 20*b* couple the first, second and third nodes (30*a*, 30*b*, 30*c*) of the at least three nodes of the first set of nodes 30. The third chord element 20*c* and the fourth chord element 20*d* couple the first, second and third nodes (40*a*, 40*b*, 40*c*) of the at least three nodes of the second set of nodes 40. This creates a space frame having a double shell both on the top and on the bottom. FIG. 2D also shows a space frame having a double shell on top and on bottom, except that the web and chord elements in this embodiment are profiled to provide further structural reinforcement.

In certain embodiments, such as shown in FIG. 2D, a number of elements from the web elements 10 and the chord elements 20 may be profiled to provide further reinforcement.

In accordance with an embodiment, the fifth type of space frame 200E, in FIG. 2E, and the sixth type of space frame 200F, in FIG. 2F, include the first chord element 20*a*, the second chord element 20*b* that are formed as one unitary structure; while the third chord element 20*c* and the fourth chord element 20*d* are formed as another unitary structure. Specifically, the first chord element 20*a* and the second chord element 20*b* are formed of a first planar sheet that forms the first surface 32 that is not bent. The third chord element 20*c* and the fourth chord element 20*d* are formed of a second sheet that forms the second surface 42 that is again not bent. Further, the web elements 10 are formed of a third sheet that is bent to create a three-dimensional exemplary unitary cell 50, which is joined to the first chord element 20*a*, the second chord element 20*b*, the third chord element 20*c* and the fourth chord element 20*d* through corresponding joints to form a space frame.

In accordance with another embodiment, such as in FIG. 2H, the chord elements are not formed as a unitary structure, but instead are constructed as separate chord elements (e.g., cables or longitudinal metal strips, which may also be profiled). Thus, the space frame 200H, in FIG. 2H, comprises the exemplary unitary cell 50 having continuous web elements only, and also comprises separate chord elements.

In accordance with an embodiment, as depicted in the second type of space frame 200B in FIG. 2B, the third type of space frame 200C in FIG. 2C, and the fourth type of space frame 200D in FIG. 2D, the first chord element 20*a* and the second chord element 20*b* are integrally formed with the exemplary unitary cell 50 at a single one (such as the first node 30*a*) of the first, second and third nodes (30*a*, 30*b*, 30*c*) of the at least three nodes of the first set of nodes 30. Further, in such embodiment, each of the first chord element 20*a* and the second chord element 20*b* extends to a different one of the other two nodes of the first nodes (30*a*, 30*b*, 30*c*) of the at least three nodes of the first set of nodes 30.

In accordance with an embodiment, as depicted in the first type of space frame 200A in FIG. 2A, the first chord element 20*a* is integrally formed with the exemplary unitary cell 50 at a first node 30*a* of the at least three nodes of the first set of nodes 30 and extending toward the second node 30*b* of the at least three nodes of the first set of nodes 30. Further, the second chord element 20*b* is integrally formed with the exemplary unitary cell 50 at the third node 30*c* of the at least three nodes of the first set of nodes 30 and extends toward the second node 30*b* of the at least three nodes of the first set of nodes 30. In accordance with another embodiment, though depicted in the first type of space frame 200A in FIG. 2A, the second chord element 20*b* is integrally formed with the exemplary unitary cell 50 at second node 30*b* of the at least three nodes of the first set of nodes 30 and extends toward the third node 30*c* of the at least three nodes of the first set of nodes 30.

In accordance with an embodiment, as depicted in the third type of space frame 200C in FIG. 2C, a fifth chord element 20*e* and a sixth chord element 20*f*, coupled with the first, second and third nodes (30*a*, 30*b*, 30*c*) of the at least three nodes of the first set of nodes 30 to form a double shell along the first surface 32 of the third type of space frame 200C. Further, a seventh chord element 20*g* and an eighth chord element 20*h*, coupled with a first, second, and third nodes (40*a*, 40*b*, 40*c*) of the at least three nodes of the second set of nodes 40 to form a double shell along the second surface 42 of the third type of space frame 200C.

In accordance with an embodiment, as depicted in each of the different types of space frames 200A to 200E, 200H and 200I in FIGS. 2A to 2E, 2H and 2I, respectively, at least one of the web elements 10 and chord elements 20 may be profiled to provide a reinforcement. Such reinforced web elements 10 and chord elements 20 exhibit high durability and high strength for load hearing.

In accordance with an embodiment, as depicted in fifth type of space frame 200E in FIG. 2E, the top surface and the bottom surface are two surfaces formed from a single sheet. Further, the central web elements 10 (references 10*a*, 10*b*, 10*c*, 10*d*, 10*e*, 10*f*, 10*g*, etc.) are also formed from a single sheet, thereby forming a unitary cell of web elements. The top surface and the bottom surface correspond to linear chord elements (20*a*, 20*b*, 20*c*, 21*d*, etc.) require holes at each intersection to attach to such individual elements. The web elements 10 (shown references 10*a*, 10*b*, 10*c*, 10*d*, 10*e*, 10*f*, 10*g*) of the unitary cell are permanently held to the chord elements via joints at both ends of each linear member to form a top set of nodes (30*a*, 30*b*, 30*c*) and bottom set of nodes (40*a*, 40*b*, 40*c*).

In accordance with an embodiment, as depicted in seventh type of space frame 200G in FIG. 2G, the top surface and the bottom surface are two surfaces formed from a single sheet. The central web elements 11 (i.e., 11*a*, 11*b*, 11*c*, 11*d*, 11*e*, 11*f*, 11*g*), however, are formed from individual elements joined at the ends. The top surface and the bottom surface correspond to linear chord elements (21*a*, 21*b*, 21*c*, 21*d*) and require holes at each intersection to attach to such individual elements. The separate elements of the central variety web elements 11, i.e., (11*a*, 11*b*, 11*c*, 11*d*, 11*e*, 11*f*, 11*g*) are permanently held together at both ends of each linear member, with hinges 15, to form a top set of nodes (31*a*, 31*b*, 31*c*) and bottom set of nodes (41*a*, 41*b*, 41*c*). Because the web elements in this embodiment are individual elements, the embodiment in FIG. 2G does not use a unitary cell.

In accordance with an embodiment, as depicted in eighth type of space frame 200H in FIG. 2H, the space frame uses the exemplary unitary cell 50 of web elements and separate chord elements. One or more of the chord elements 20 can be a cable element. Such eighth type of space frame 200H may be preferred in certain use cases where light-weight space frames are to be installed, as usage of cable elements as chord elements drastically reduce the weight of the eighth type of space frame 200H.

In accordance with an embodiment, as depicted in ninth type of space frame 200I in FIG. 2I, the chord element spanning two nodes, such as first node 30*a* and second node 30*b* of the first set of nodes 30 comprises a pair of sub-chord elements, such as 22 and 24. Each sub-chord element of the pair of sub-chord elements 22 and 24 has a first end (22*a*, 24*a*) and a second end (22*b*, 24*b*), respectively. The first ends (22*a*, 24*a*) of each sub-chord elements 22 and 24 are secured to each other, using a fastening mechanism, such as one of a second set of bolt-and-nut member 61. The second end 22*b* of one sub-chord element 22 of the pair of sub-chord elements is integrally formed with the exemplary unitary cell 50 at one of the nodes, i.e., first node 30*a*. The second end 24*b* of the other sub-chord element 24 of the pair of sub-chord elements is integrally formed with the exemplary unitary cell 50 at the other node of the two nodes, i.e., the second node 30*b*. For sake of simplicity, the description and structure of only sub-chord members is provided. The same description and structure holds true for other sub-chord members, without any deviation from the scope of the disclosure. The plan view 201I shows a sheet of material from which the exemplary unitary cell 50, having the web and chord (sub-chord) elements is formed.

In accordance with a second aspect of the present disclosure, the tenth type of space frame 200J, the eleventh type of space frame 200K, and the twelfth type of space frame 200L in respective FIGS. 2J, 2K, and 2L, comprise the first set of nodes 30 located along the first surface 32, the second set of nodes 40 located along the second surface 42, and a plurality of unitary three-dimensional strut structures 52. The second surface 42 is non-intersecting with the first surface 32. Each unitary three-dimensional start structure 52 comprises a set of three extensions separately extending from a root node, such as the node 30*a*, to a set of three other nodes. The root node, such as the node 30*a*, may be one of the first set of nodes 30 located along the first surface 32. The set of three other nodes may comprise one node, such as the node 30*b*, located along the first surface 32. The set of three other nodes may further comprise two nodes, such as nodes 40*a* and 40*d*, located along the second surface 42.

In accordance with an embodiment, the second aspect of the disclosure pertains to a unitary three-dimensional strut structure having three extensions from the root node, such as the node 30*a*, to any three other nodes, such as the nodes 30*b*, 40*a* and 40*d*. The second aspect of the disclosure is different from the first aspect of the disclosure as it includes space frames in FIGS. 2J-2L. In addition, the second aspect of the disclosure also includes the first type of space frame 200A in FIG. 2A through fourth type of space frame 200D in FIG. 2D, as well the ninth type of space frame 200I in FIG. 2I.

In accordance with an embodiment, at least one of extensions in the eleventh type of space frame 200K (in FIG. 2K) cats have a tubular shape. The tubular shape of the extensions correspond to a structure designed to act like a three-dimensional hollow tube to resist lateral loads and provide a lightweight rigid structure. Nevertheless, the profile of such three-dimensional hollow tube may be reinforced to provide additional strength to the tenth and twelfth types of space frames 200J (FIG. 2J) and 200L (FIG. 2L), respectively.

In accordance with another embodiment, the second aspect of the disclosure pertains to the unitary three-dimensional structure having direct extensions from the root node, such as the node 30*a* to four other nodes. Thus, in addition to the aforesaid three legs or extensions, the unitary three-dimensional structure 52 may further comprise a fourth node, such as node 30*d*, located along the first surface 32. A fourth extension extends from the root node, such as node 30*a*, to the fourth node, such as node 30*d*. Accordingly, two of the four extensions are web elements, such as web elements 10*a* and 10*h*, and the other two of the four extensions are chord elements, such as the chord elements 20*a* and 20*d*. Thus four-legged unitary three-dimensional structures are shown individually as reference 201J (FIG. 2J), 201K (FIG. 2K), and 201*l* (FIG. 2L), respectively.

In accordance with an embodiment, each of the tenth type of space frame 200J, the eleventh type of space frame 200K, and the twelfth type of space frame 200L comprises a plurality of joined unitary three-dimensional strut structures. For exemplary purposes, one of such plurality of joined unitary three-dimensional strut structures may be the unitary three-dimensional strut structure 52 with root node, such as node 30*a*. Other of such plurality of joined unitary three-dimensional strut structures may be the unitary three-dimensional strut structure 54 with root node, such as node 30*e*.

In accordance with such embodiments, as depicted clearly in the twelfth type of space frame 200L in FIG. 2L, the two unitary three-dimensional structures, for example the unitary three-dimensional strut structures 52 and 54, and nine separate extensions elements (shown in the assembled space frame as elements 10*c*, 10*d*, 10*g*, 10*h*, 10*i*, 20*a*, 20*p*, and 20*q*) are joined to form a three-dimensional space frame. In such embodiments, the three-dimensional frames include a plurality of chord elements of the chord elements 20 along the first surface 32 offset from a plurality of chord elements of the chord elements 20 along the second surface 42. In other words, the chord elements 20 along the first surface 32 are offset with respect to chord elements 20 along the second surface 42.

In accordance with an embodiment, the thirteenth type of space frame 200M comprises two types of continuous strips, for example continuous flat strips 12 and continuous bent strips 14 that are joined together at their intersections to form one of the first set of nodes 30. Specifically, the thirteenth type of space frame 200M has an array of the continuous flat strips 12 forming a grid pattern at the top that may correspond to the first surface 32. Another array of the continuous flat strips 12 forming a grid pattern at the bottom that may correspond to the second surface 42. The central (web) member is formed from an array of six continuous bent strips 14. The continuous flat strips 12 and continuous bent strips 14 are then joined at their intersections that correspond to the first set of nodes 30 (located at the first surface 32) and the second set of nodes 40 (located at the second surface 42). In an embodiment, the continuous flat strips 12 may be bent into shape prior to installation.

Figure 3:
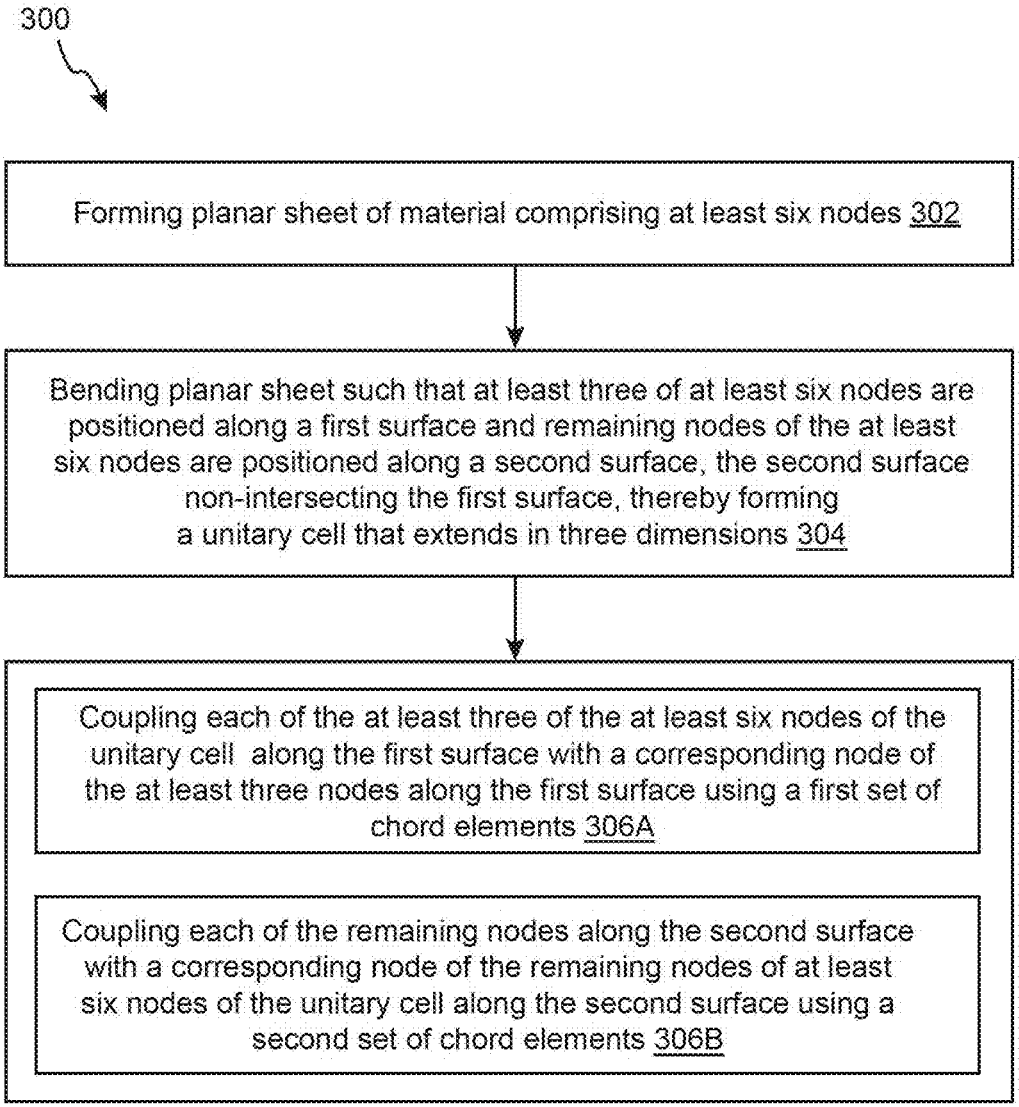
FIG. 3 depicts a method of creating a space frame, in accordance with various embodiments of the present disclosure.

In accordance with a third aspect of the present disclosure, a method of creating a space frame is disclosed. Turning to FIG. 3, there is depicted a method 300 of creating the space frame, such as different types of space frames 200A to 200F, and 200H to 200I, in accordance with various embodiment of the present disclosure that utilize the exemplary unitary cell 50 element.

At step 302, the method 300 may include forming a planar sheet of material (e.g., steel, aluminium, etc.) comprising at least six nodes. For example, with reference to the initial schematic diagram 100A in FIG. 1A, the single horizonal planar sheet 55 comprises sixteen nodes that includes eight nodes corresponding to the first set of nodes 30 and eight nodes corresponding to the second set of nodes 40. In an exemplary scenario, the planar sheet 55 may correspond to the first surface 32 of the assembled space frame. It may be noted that the above example is merely for understanding purpose and should not be construed to limit the scope of the disclosure.

At step 304, the method 300 may include bending the sheet such that at least three of the at least six nodes are positioned along a first surface and the remaining nodes are positioned along a second surface, the second surface non-intersecting the first surface, thereby forming the exemplary unitary cell 50 that extends in three dimensions. For example, with reference to the intermediate schematic diagrams 100B and 100C to the final schematic diagram 100D in FIG. 1A, the unitary planar structure may start bending such that eight nodes corresponding to the first set of nodes 30 are positioned along a first surface 32 and the remaining eight nodes of the second set of nodes 40 positioned along the second surface 42, as described in detail in FIGS. 1C and 2B. The second surface 42 is non-intersecting with the first surface 32, thereby causing the exemplary unitary cell 50 to extend in three dimensions.

At step 306A, the method 300 may include coupling each of the at least three nodes along the first surface with a corresponding node of the at least three nodes along the first surface using a first set of chord elements. For example, the unitary planar structure also includes integrally formed extensions that, when the structure is bend, form chord elements of the space frame. With reference to the final schematic diagram 100D in FIG. 1A, each of the eight nodes along the first surface 32 may be coupled with at least one other nodes of the eight nodes via a chord element along the first surface 32. At step 306B, the method 300 may include coupling each of the at least three nodes along the second surface with a corresponding node of the at least three nodes along the second surface using a second set of chord elements. For example, with reference to the final schematic diagram 100D in FIG. 1A, each of the eight nodes along the second surface 42 may be coupled with at least one nodes of the eight nodes along via a chord element along the second surface 42.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The proposed space frame provides various advantages over the existing solutions. For example, in accordance with an existing solution pertaining to OWSJs, two-dimensional structure, narrow web members, reduced weight or mass introduce certain concerns, such as fire protection and floor vibrations. The proposed space frame overcomes the limitation of the existing solution by introducing three-dimensional structure as joints share linear members with at least three other joints of the same variety and a central variety of linear members span between joints of the two neighbouring varieties. Accordingly, the proposed space frame provides reasonable fire protection and are more resistant to floor vibrations.

In accordance with another existing solution, composite panel structure and foldable space frame have only a central linear member that is unified. Further, in trussed structures unification of multiple central linear members is not achieved by folding back and doubling up the material. On the contrary, the proposed space frame provides central variety linear members, that consist of a single, intact, and continuous piece of material. Further, such features facilitates hassle-free compression of the structure when transported to a different facility. Further, the expansion of the structure is also quite easy when installed at the facility for operational purposes.

In accordance with another existing solution, space frame has joints consisting of stacked, unified linear members, existing in just a single variety of joints. In contrast, the proposed space frame provides joints of multiple varieties that have at least two linear members consisting of a single, intact piece of material and therefore these unified linear members only occupy a single layer of the 'joint stack'. Such a feature provides a versatile, highly flexibile and highly durable space frame preferred in the field of architectural and structural engineering.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Unless stated otherwise, terms such as "first" and "second" are used to arbitrarily distinguish between the elements such terms describe. Thus, these terms are not necessarily intended to indicate temporal or other prioritization of such elements.

Unless otherwise stated, conditional languages such as "can", "could", "will", "might", or "may" are understood within the context as used in general to convey that certain embodiments include, while other embodiments do not include, certain features and/or elements. Thus, such conditional languages are not generally intended to imply that features and/or elements are in any way required for one or more embodiments.

It will be understood by those within the art that, in general, terms used herein, are generally intended as "open" terms (e.g., the term "including" should be interpreted as "including but not limited to", the term "having" should be interpreted as "having at least", the term "includes" should be interpreted as "includes but is not limited to", etc.). The term "coupled" should be interpreted to include both direct and indirect coupling.

What is claimed is:

1. A space frame comprising:

a first set of nodes located along a first surface;

a second set of nodes located along a second surface, the second surface non-intersecting the first surface; and a unitary cell comprising at least four continuous web elements and extending in three dimensions, the unitary cell spanning at least two nodes of the first set of nodes and at least two nodes of the second set of nodes;

wherein the space frame is a unitary structure of one-piece construction composed of a single piece of material.

2. The space frame of claim 1, wherein the unitary cell comprises at least seven continuous web elements and spans at least three nodes of the first set of nodes and at least three nodes of the second set of nodes.

3. A space frame comprising:

a first set of nodes located along a first surface;

a second set of nodes located along a second surface, the second surface non-intersecting the first surface;

a unitary cell comprising at least seven continuous web elements and extending in three dimensions, the unitary cell spanning at least three nodes of the first set of nodes and at least three nodes of the second set of nodes;

a first chord element and a second chord element, the first and second chord elements coupling a first node, a second node, and a third node of the at least three nodes of the first set of nodes; and a third chord element and a fourth chord element, the third and fourth chord elements coupling a first node, a second node, and a third node of the at least three nodes of the second set of nodes.

4. The space frame of claim 3, wherein at least one of (i) the first and second chord elements and (ii) the third and fourth chord elements are integrally formed with the unitary cell.

5. The space frame of claim 3, further comprising:

a fifth chord element and a sixth chord element, the fifth and sixth chord elements integrally formed with the unitary cell and coupling the first, second and third nodes of the at least three nodes of the first set of nodes to form a double shell along the first surface of the space frame; and a seventh chord element and an eighth chord element, the seven and eighth chord elements integrally formed with the unitary cell and coupling a first, second, and third nodes of the at least three nodes of the second set of nodes to form a double shell along the second surface of the space frame.

6. The space frame of claim 3, wherein at least one of (i) the chord elements and (ii) the web elements is profiled to provide reinforcement.

7. The space frame of claim 3, wherein at least one of the chord elements comprises a cable.

8. The space frame of claim 3, wherein a chord element spanning two nodes comprises a pair of sub-chord elements, wherein each sub-chord element of the pair of sub-chord elements has a first end and a second end, wherein the first ends of each sub-chord elements are secured to each other, wherein the second end of one sub-chord element of the pair of sub-chord elements is integrally formed with the unitary cell at one of the two nodes, and wherein the second end of the other sub-chord element of the pair of sub-chord elements is integrally formed with the unitary cell at the other node of the two nodes.

9. The space frame of claim 3, wherein the first chord element is integrally formed with the unitary cell at the first node of the at least three nodes of the first set of nodes and extending toward the second node of the at least three nodes of the first set of nodes, and wherein the second chord element is one of (i) integrally formed with the unitary cell at the second node of the at least three nodes of the first set of nodes and extends toward the third node of the at least three nodes of the first set of nodes, and (ii) integrally formed with the unitary cell at the third node of the at least three nodes of the first set of nodes and extends toward the second node of the at least three nodes of the first set of nodes.

10. The space frame of claim 9, wherein the first chord element is joined with the unitary cell at the second node of the at least three nodes of the first set of nodes by a bolt-and-nut connection.

11. The space frame of claim 3, wherein the first and second chord elements are integrally formed with the unitary cell at a single one of the first, second, and third nodes of the at least three nodes of the first set of nodes, and wherein each of the first and second chord elements extends toward a different one of the other two nodes of the first, second, and third nodes of the at least three nodes of the first set of nodes.

12. The space frame of claim 11, wherein the first and second chord elements are joined to the unitary cell at a different one of the other two nodes of the first, second, and third nodes of the at least three nodes of the first set of nodes by a bolt-and-nut connection.

13. The space frame of claim 11, wherein the first and second chord elements are joined to the unitary cell at a different one of the other two nodes of the first, second, and third nodes of the at least three nodes of the first set of nodes by a welded connection.

14. A space frame comprising:

a first set of nodes located along a first surface;

a second set of nodes located along a second surface, the second surface non-intersecting with the first surface; and a unitary three-dimensional strut structure comprising a set of three extensions separately extending from a root node to a set of three other nodes of the space frame, respectively, wherein the root node and one of the three other nodes are located along the first surface, and wherein two of the three other nodes are located along the second surface;

wherein the space frame is a unitary structure of one-piece construction composed of a single piece of material.

15. The space frame of claim 14, wherein at least one of the extensions has a tubular shape.

16. The space frame of claim 14, wherein the unitary three-dimensional strut structure further comprises a fourth node located along the first surface, wherein a fourth extension extends from the root node to the fourth node, wherein two of the four extensions are web elements and the other two of the four extensions are chord elements.

17. A space frame comprising:

a first set of nodes located along a first surface;

a second set of nodes located along a second surface, the second surface non-intersecting with the first surface; and a plurality of joined unitary three-dimensional strut structures each comprising a set of three extensions separately extending from a root node to a set of three other nodes of the space frame, respectively, wherein the root node and one of the three other nodes are located along the first surface, wherein two of the three other nodes are located along the second surface, wherein a fourth node of one of the unitary three-dimensional strut structures is located along the first surface, and a fourth extension extends from the root node to the fourth node, and wherein two of the four extensions are web elements and the other two of the four extensions are chord elements.

18. The space frame of claim 17, further comprising two unitary three-dimensional strut structures and nine separate longitudinal members joined to form a three-dimensional frame having a plurality of chord elements along the first surface offset from a plurality of chord elements along the second surface.

* * * * *